US008522744B2

(12) United States Patent
Takiguchi et al.

(10) Patent No.: US 8,522,744 B2
(45) Date of Patent: Sep. 3, 2013

(54) LUBRICATING STRUCTURE FOR AN INTERNAL COMBUSTION ENGINE

(75) Inventors: Chikashi Takiguchi, Saitama (JP); Junji Konaka, Saitama (JP); Ryuji Maeda, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 352 days.

(21) Appl. No.: 12/726,018

(22) Filed: Mar. 17, 2010

(65) Prior Publication Data

US 2010/0242895 A1 Sep. 30, 2010

(30) Foreign Application Priority Data

Mar. 31, 2009 (JP) ..... 2009-088261

(51) Int. Cl.
*F01M 11/02* (2006.01)

(52) U.S. Cl.
USPC ..... 123/196 R; 123/198 C; 123/198 E; 184/6.21; 184/6.22

(58) Field of Classification Search
USPC ..... 123/196 R, 196 S, 198 C, 198 E; 184/6.21, 6.22
See application file for complete search history.

(56) References Cited

U.S. PATENT DOCUMENTS

| | | | | |
|---|---|---|---|---|
| 5,617,822 | A * | 4/1997 | Masuda | 123/196 R |
| 5,937,817 | A * | 8/1999 | Schanz et al. | 123/196 AB |
| 6,202,621 | B1 * | 3/2001 | Inumaru et al. | 123/196 R |
| 6,540,047 | B2 * | 4/2003 | Yasui et al. | 184/104.2 |
| 6,554,104 | B2 * | 4/2003 | Ohyama et al. | 184/6.28 |
| 6,578,541 | B2 * | 6/2003 | Stromsky et al. | 123/196 R |
| 7,089,905 | B2 * | 8/2006 | Tsutsumi et al. | 123/196 R |
| 7,121,249 | B2 * | 10/2006 | Hamada et al. | 123/196 R |
| 7,240,657 | B2 * | 7/2007 | Watanabe | 123/196 R |
| 7,264,086 | B2 * | 9/2007 | Ito et al. | 184/6.22 |
| 7,343,833 | B2 * | 3/2008 | Matsushima | 74/607 |
| 7,559,307 | B2 * | 7/2009 | Inui et al. | 123/196 A |
| 7,578,277 | B2 * | 8/2009 | Inui et al. | 123/192.2 |
| 2005/0199213 | A1 * | 9/2005 | Hamada et al. | 123/196 R |
| 2008/0236537 | A1 * | 10/2008 | Terada et al. | 123/196 AB |

FOREIGN PATENT DOCUMENTS

| | | |
|---|---|---|
| JP | 2000-161038 A | 6/2000 |
| JP | 2007-170314 | 7/2007 |

* cited by examiner

*Primary Examiner* — Noah Kamen
*Assistant Examiner* — Grant Moubry
(74) *Attorney, Agent, or Firm* — Birch, Stewart, Kolasch & Birch, LLP

(57) ABSTRACT

An internal combustion engine wherein the oil heat radiation amount from an oil chamber can be increased. A crank side oil chamber formed in a crankcase is divided into a first oil chamber and a second oil chamber with first openings for communicating with a transmission side oil chamber formed in a transmission case being provided in the first oil chamber while a second opening for communicating with the second oil chamber is provided in the transmission side oil chamber.

18 Claims, 14 Drawing Sheets

LUBRICATING STRUCTURE FOR AN INTERNAL COMBUSTION ENGINE

CROSS-REFERENCE TO RELATED APPLICATIONS

The present application claims priority under 35 USC 119 to Japanese Patent Application No. 2009-088261 filed on Mar. 31, 2009 the entire contents of which are hereby incorporated by reference.

BACKGROUND OF THE INVENTION

1. Field of the Invention

This invention relates to an internal combustion engine having an oil chamber.

2. Description of Background Art

An internal combustion engine for a vehicle is known which includes a transmission case provided on one side of a crankcase for supporting a crankshaft and further includes a cover member provided on the transmission case for covering the sides while a transmission is accommodated by the transmission case and the cover member.

In an engine of the type described, an oil chamber is formed at a lower portion of the crankcase and oil in the oil chamber is pressure-fed to a cylinder or the like of the engine by an oil pump provided between the crankcase and the transmission case. See, for example, Japanese Patent Laid-Open No. 2007-170314.

However, according to the conventional structure, since oil fed into the cylinder or the like is heated and is pressure-fed to the cylinder or the like by the oil pump immediately after it returns into the oil chamber, although the oil radiates some heat through an outer surface of the crankcase only for a short period of time for which the oil stays in the oil chamber after returned, the amount of the radiated heat is small. Therefore, the oil is reserved normally in a state wherein the temperature thereof remains high.

In an air-cooled engine, although the engine itself is cooled by heat radiating fins provided on the cylinder, unless an oil cooler is provided separately, the oil is cooled very little. Accordingly, in a conventional engine which does not include an oil cooler, if the engine is operating, then the oil basically continues to be heated.

On the other hand, although it is a possible idea to add a large-sized oil cooler to achieve compulsory cooling of the oil, this increases the number of parts and gives rise to an increase in the cost and the weight. In addition, since it is necessary to assure also the arrangement space for the parts, where the arrangement space cannot be assured, the addition of the oil cooler is difficult.

SUMMARY AND OBJECTS OF THE INVENTION

The present invention has been made in view of the situation described above, where it is an object of an embodiment of the present invention to provide an internal combustion engine wherein the heat radiation amount of oil from an oil chamber can be increased.

In order to solve the problem described above, according to an embodiment of the present invention, an internal combustion engine with a transmission case which accommodates a transmission is provided on one side of a crankcase which supports a crankshaft and a crank side oil chamber is provided at a lower portion of the crankcase. A transmission side oil chamber partitioned from a transmission accommodation section is provided at a lower portion of the transmission case such that oil is circulated through the transmission side oil chamber.

According to an embodiment of the present invention, since the transmission side oil chamber partitioned from the transmission accommodation section is provided at the lower portion of the transmission case such that the oil is circulated through the transmission side oil chamber, the oil flow path in the oil chamber can be made long and the oil residence time can be made long. Thus, the oil heat radiation amount from the oil chamber can be increased.

In the configuration described above, the crank side oil chamber may have a first oil chamber and a second oil chamber separate from each other, and a first opening which communicates with the transmission side oil chamber may be provided in the first oil chamber while a second opening which communicates with the second oil chamber is provided in the transmission side oil chamber. With this configuration, the oil entering the first oil chamber of the crank side oil chamber can be fed past the transmission side oil chamber and the second oil chamber in order, and the oil heat radiation amount from the oil chamber can be increased efficiently.

In the configuration described above, a third opening which communicates with a strainer of an oil pump may be provided in the second oil chamber. With this configuration, since the oil in the first oil chamber and the transmission side oil chamber enters the strainer chamber past the second oil chamber, the oil from which heat has been radiated can be supplied to the strainer.

Further, in the configuration described above, the first oil chamber may be provided at a position to which returning oil from a cylinder section of the internal combustion engine drops and the second oil chamber may be provided rearwardly of the first oil chamber while the strainer chamber is provided forwardly of the second oil chamber below the first oil chamber. With this configuration, the returning oil from the cylinder section can be dropped into the first oil chamber with certainty so that heat radiation from the oil chamber can be carried out efficiently, and the first oil chamber and the strainer chamber can be disposed in an overlapping relationship with each other as viewed from above. Consequently, a limited space can be utilized efficiently to dispose the first oil chamber, second oil chamber and strainer chamber.

In the configuration described above, the second opening may be positioned lower than the first opening and the third opening is positioned lower than the second opening. With this configuration, the oil can be smoothly fed from the first oil chamber to the transmission side oil chamber and can be smoothly fed from the transmission side oil chamber to the second oil chamber by making use of gravity.

Further, in the configuration described above, the transmission side oil chamber may be positioned below the transmission chamber of the transmission case in which the transmission is accommodated. With this configuration, the oil heat radiation face of the transmission side oil chamber can be made wide.

Further, in the configuration described above, a guide member for guiding returning oil from a cylinder section of the internal combustion engine to the transmission side oil chamber may be provided on the inner side of the crankcase. With this configuration, the returning oil from the cylinder chamber can be guided smoothly to the transmission side oil chamber.

Further, in the configuration described above, the guide member may be provided so as to extend between left and right walls of the crankcase. With this configuration, the returning oil from the cylinder section can be guided to the transmission side oil chamber with a higher degree of certainty.

According to an embodiment of the present invention, since the transmission side oil chamber partitioned from a transmission accommodation section is provided at a lower portion of the transmission case such that the oil is circulated through the transmission side oil chamber, the oil flow path in the oil chamber can be made long and the oil residence time can be made long. Consequently, the heat radiation amount from the oil chamber can be increased and oil from which heat has been radiated is accumulated into an oil reservoir.

Further, since the crank side oil chamber has the first oil chamber and the second oil chamber separated from each other and the first opening which communicates with the transmission side oil chamber is provided in the first oil chamber while the second opening which communicates with the second oil chamber is provided in the transmission side oil chamber, the oil heat radiation amount from the oil chamber can be increased efficiently.

Further, since the third opening which communicates with the strainer of the oil pump is provided in the second oil chamber, and the oil in the first oil chamber and the transmission side oil chamber enters the strainer chamber past the second oil chamber, oil from which heat has been radiated can be supplied to the strainer.

Further, since the first oil chamber is provided at the position to which returning oil from the cylinder section of the internal combustion engine drops and the second oil chamber is provided rearwardly of the first oil chamber while the strainer chamber is provided forwardly of the second oil chamber below the first oil chamber, the returning oil from the cylinder section can be dropped into the first oil chamber with certainty so that heat radiation from the oil chamber can be carried out efficiently. Further, a limited space can be utilized efficiently to dispose the first oil chamber, second oil chamber and strainer chamber.

Further, since the second opening is positioned lower than the first opening and the third opening is positioned lower than the second opening, the oil can be smoothly fed from the first oil chamber to the transmission side oil chamber and can be smoothly fed from the transmission side oil chamber to the second oil chamber by making use of gravity.

Further, since the transmission side oil chamber is positioned below the transmission chamber of the transmission case in which the transmission is accommodated, heat radiation can be carried out using the outer surface of the transmission side oil chamber and the oil heat radiation face can be made wide.

Further, since the guide member for guiding returning oil from the cylinder section of the internal combustion engine to the transmission side oil chamber is provided on the inner side of the crankcase, the returning oil from the cylinder chamber can be guided smoothly to the transmission side oil chamber.

Further, since the guide member is provided so as to extend between the left and right walls of the crankcase, the returning oil from the cylinder section can be guided to the transmission side oil chamber with a higher degree of certainty.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

In the following, an embodiment of the present invention is described with reference to the drawings.

It is to be noted that, in the following description, unless otherwise specified, the representations of the directions such as forward, backward, leftward, rightward and upward, downward directions are the same as the directions of a vehicle. Further, an arrow mark F in the figures indicates the forward direction of the vehicle body, another arrow mark R the rightward direction of the vehicle body, and a further arrow mark U the upward direction of the vehicle body.

Figure 1:
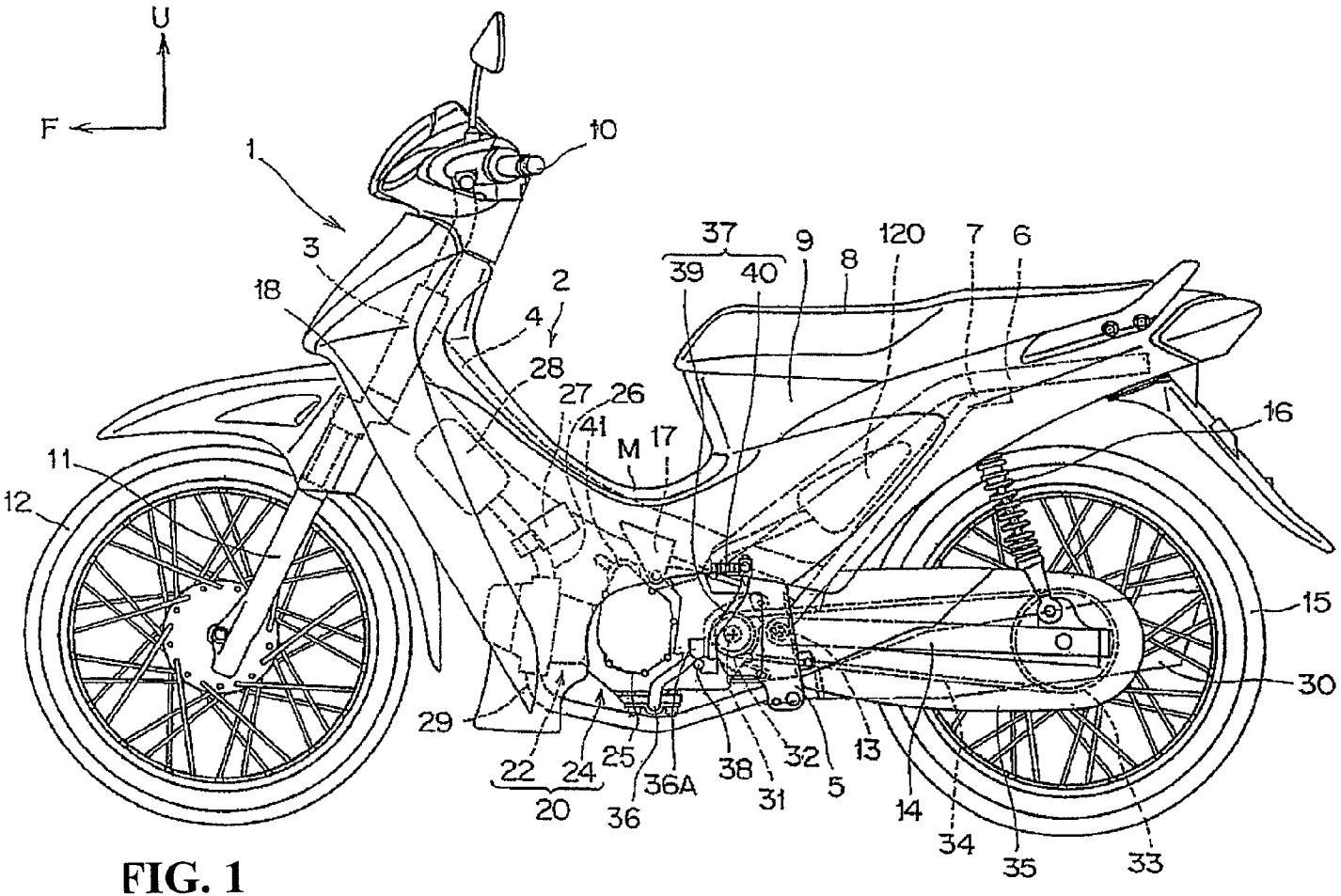
FIG. 1 is a side elevational view of a motorcycle to which an embodiment of the present invention is applied.

FIG. 1 is a side elevational view of a motorcycle 1 to which an embodiment of the present invention is applied.

A vehicle body frame 2 of the present motorcycle 1 includes a head pipe 3 at a front portion of the vehicle body, a single main frame 4 extending in an obliquely downward direction toward the rear from the head pipe 3, a pair of left and right pivot brackets 5 secured to a rear portion of the main frame 4 and extending downwardly, a pair of left and right seat rails 6 extending obliquely upwardly toward the back from the securing position of the pivot brackets 5 at a rear portion of the main frame 4, bent midway and coming to rear ends thereof, and a pair of left and right reinforcing frames 7 for the reinforcement between the pivot brackets 5 and middle portions of the seat rails 6.

A rider's seat 8 is provided above the pair of left and right seat rails 6 of the vehicle body frame 2, and an accommodation section (accommodating box) 9 is provided below the rider's seat 8. A steering bar 10 supported for pivotal motion on the head pipe 3 is provided at an upper portion of a front portion of the vehicle body, and a pair of front forks 11, 11 extending below the steering bar 10 and a front wheel 12 is supported for rotation at lower ends of the front forks 11, 11. A rear fork 14 is supported at a front end thereof for rocking motion on a pivot shaft 13 at the pivot brackets 5 in the middle of the vehicle body and extends rearwardly, and a rear wheel 15 is supported for rotation at a rear end portion of the rear fork 14. A pair of left and right rear shock absorbers 16 are interposed between a rear portion of the rear fork 14 and the seat rails 6.

An engine (also referred to as power unit) 20 in the form of an internal combustion engine is suspended below the main frame 4 forwardly of the pivot brackets 5. A support bracket 17 provided vertically at a central portion of the main frame 4 is suspended above the engine 20, and the engine 20 is secured at two portions thereof to the pivot brackets 5. In other words, the engine 20 is supported in a manner wherein it is suspended downwardly at a rear portion of the main frame 4. Further, the vehicle body frame 2 is covered with a vehicle body cover 18 made of a synthetic resin and divided into several portions.

The engine 20 is a single-cylinder 4-cycle air-cooled engine and is formed as a horizontal engine wherein a cylinder section 22 is inclined forwardly by a great amount from the front face of a crankcase 24 to such a state proximate to a substantially horizontal state. Therefore, the vehicle body can be formed such that the center of gravity thereof is positioned low, and the main frame 4 can be made as low as seen from FIG. 1 so that a stepping over portion M over which a driver steps when he/she gets on the motorcycle 1 can be set low and the facility in getting on and off can be enhanced. Further, a generator cover 25 is attached to a front portion of the left side face of the crankcase 24. The vehicle body cover 18 has a cover shape for covering the vehicle body up to a position in the proximity of an outer edge of the crankcase 24 as viewed in a side elevation of the vehicle body while the side face of the crankcase 24 including the generator cover is exposed to the outside.

An intake pipe 26 is connected to the upper side of the cylinder section 22 of the engine 20. This intake pipe 26 extends upwardly and is connected to a throttle body 27 and an air cleaner 28 supported on the main frame 4. An exhaust pipe 29 is connected to the lower side of the cylinder section 22. This exhaust pipe 29 extends downwardly and is bent such that it extends rearwardly until it is connected to a muffler 30 disposed on the right side with respect to the rear wheel 15.

Meanwhile, an output power shaft 31 of the engine 20 is supported for rotation at a rear portion of the left side face of the crankcase 24 such that an end thereof is exposed. A driving sprocket wheel 32 is attached to the end of the output power shaft 31, and a power transmitting chain 34 (refer to FIG. 1) extends between and around the driving sprocket wheel 32 and a driven sprocket wheel 33 provided integrally on the rear wheel 15 to configure a chain driving mechanism. Accordingly, rotation of the output power shaft 31 of the engine 20 is transmitted to the rear wheel 15 through the chain driving mechanism. It is to be noted that this chain driving mechanism functions also as a secondary speed reducing mechanism for setting the reduction ratio (secondary reduction ratio) between the output power shaft 31 and the rear wheel shaft depending upon the ratio of tooth numbers of the sprocket wheels 32 and 33. A cover 35 is provided for covering the chain driving mechanism.

A step bar 36 which extends in the left and right directions of the vehicle body is attached to a lower portion of the crankcase 24, and a pair of steps 36A, 36A on which the driver is to place his/her feet are attached to the opposite ends of the step bar 36.

Further, in the present motorcycle 1, a kick member (starting system member) 37 which configures part of a kick type starting apparatus 140 for starting the engine 20 is disposed on the left sidewardly of the crankcase 24. More specifically, the kick member 37 includes a kick arm 39 attached to a kick shaft 38 supported for rotation on the crankcase 24 with an end thereof exposed, and a kick pedal 40 attached for rotation at an end portion of the kick arm 39. The driver can step the kick pedal 40 to rotate to the kick shaft 38 to start the engine 20.

Furthermore, the motorcycle 1 also includes a starter motor 41 for starting the engine that is disposed in addition to the kick type starting apparatus 140. This starter motor 41 is attached to a front portion of the upper face of the crankcase 24. The engine 20 can be started by operating the starter motor 41. In other words, the present motorcycle 1 is configured such that the engine 20 can be started by any of the kick type method and the starter motor type method.

Figure 2:
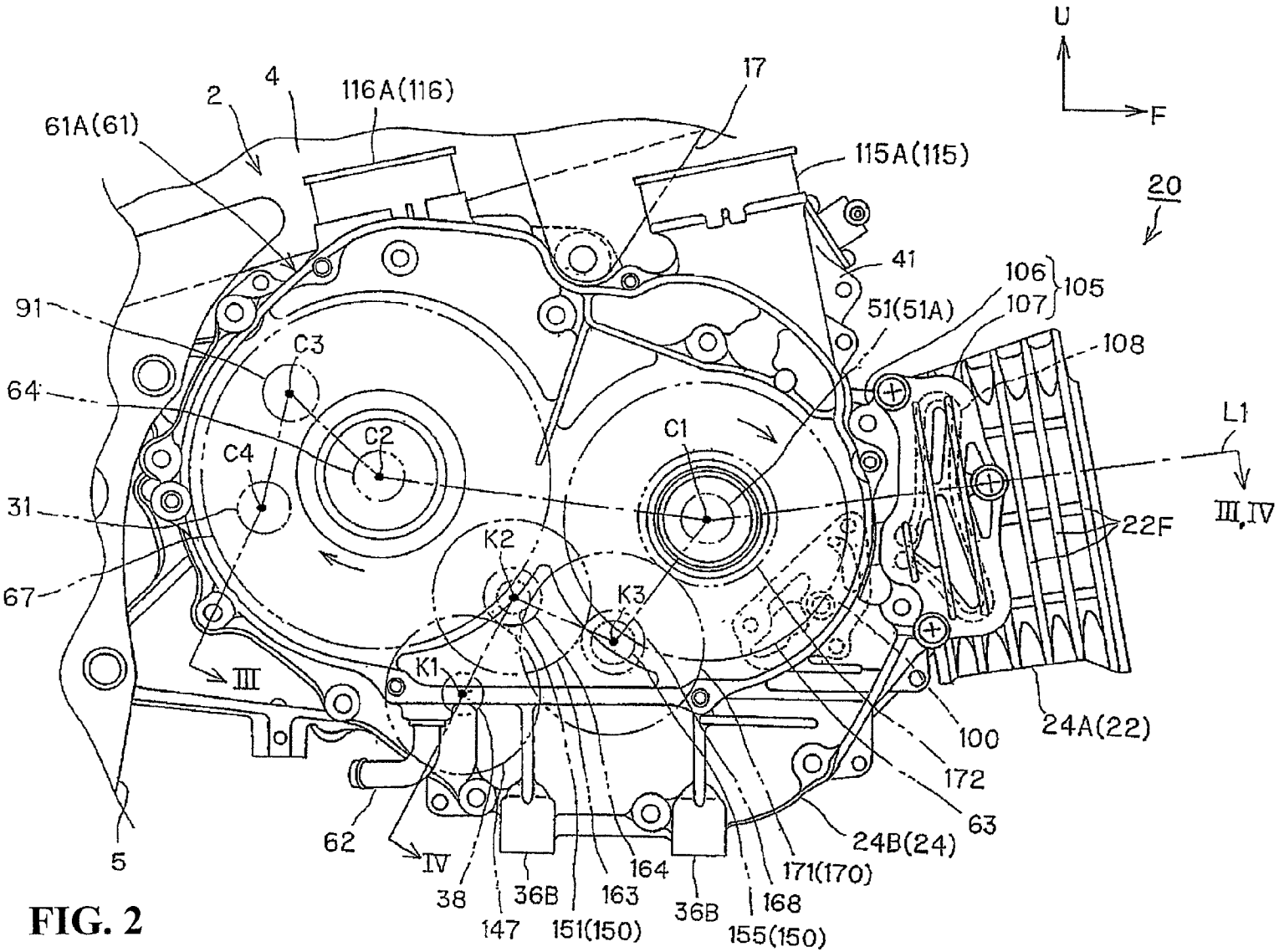
FIG. 2 is a view showing an internal structure of an engine of the motorcycle as viewed from the right side of a vehicle body.

FIG. 2 is a view showing an internal structure of the engine 20 as viewed from the right side of the vehicle body and shows the position of principal rotary shafts of the power transmission system and the starting system. Also a cylinder axial line L1 is shown. Meanwhile, FIG. 3 is a view showing a section taken along line III-III.

Figure 3:
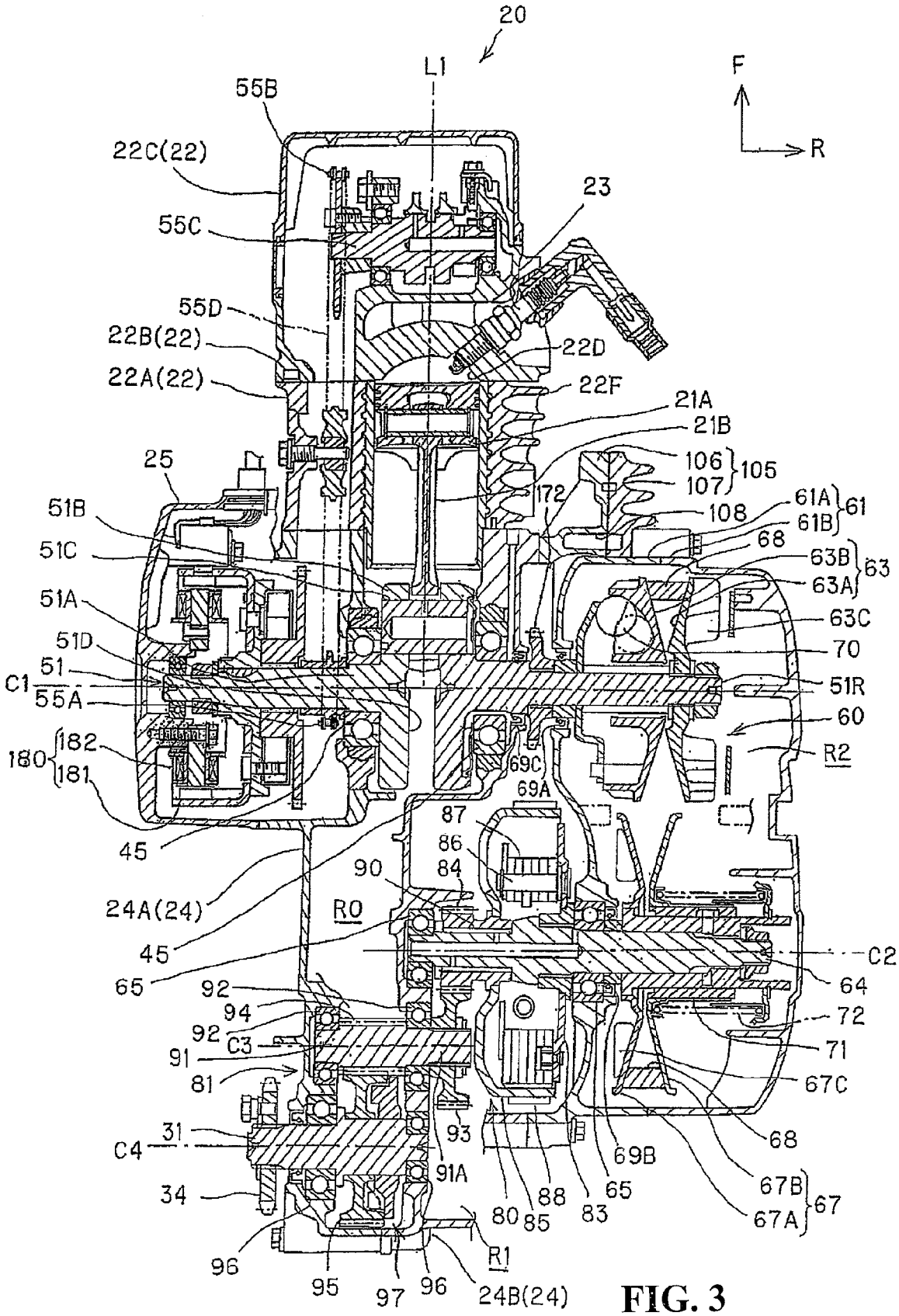
FIG. 3 is a view showing a section taken along line III-III of FIG. 2.

As shown in FIGS. 2 and 3, the cylinder section 22 of the engine 20 includes a cylinder block 22A connected to the front face of the crankcase 24, a cylinder head 22B connected to the front face of the cylinder block 22A, and a head cover 22C for covering the front face of the cylinder head 22B. On the cylinder head 22B, a combustion chamber 22D and an intake port and an exhaust port, not shown, are connected to the combustion chamber 22D. An ignition plug 23 is disposed such that an end thereof faces the combustion chamber 22D. The intake pipe 26 is connected to an entrance of the intake port. The exhaust pipe 29 is connected to an exit of the exhaust port. Further, in FIG. 2, a heat radiating fin 22F is provided on the cylinder section 22, and the cylinder section 22 is air-cooled by the heat radiating fins 22F.

As shown in FIG. 3, the crankcase 24 of the engine 20 is formed to the left and right with two-divisional part structure including a left crankcase 24A and a right crankcase 24B. A crankshaft 51 is supported laterally for rotation at a front portion of the crankcase 24 through a pair of left and right bearings (roll bearings) 45, 45 supported on the left and right crankcases 24A and 24B such that an axis C1 thereof extends perpendicularly to the advancing direction of the vehicle.

This crankshaft 51 includes a crank journal 51A serving as the center of rotation, a crank web 51B formed with a diameter greater than that of the crank journal 51A and a crank pin (eccentric shaft) 51C supported through the crank web 51B. The crank web 51B and the crank pin 51C are positioned between the pair of left and right bearings 45, 45. Further, a balance weight (hereinafter referred to as weight) 51D for establishing a balance in rotation is provided on the crank web 51B.

A piston 21A disposed for sliding movement along the cylinder axial line L1 in the cylinder section 22 is connected to the crank pin 51C of the crankshaft 51 through a connecting rod 21B. Further, in FIG. 3, a sprocket wheel 55A is provided on the crankshaft 51 with a sprocket wheel 55B provided on a camshaft 55C provided in the head cover 22C of the cylinder section 22. The sprocket wheels 55A and 55B are connected to each other through a cam chain 55D. Consequently, a valve motion wherein the camshaft 55C is rotated in response to rotation of the crankshaft 51 to push or move intake and exhaust valves not shown provided in the cylinder head 22B.

A belt type continuously variable transmission 60 is provided on the right side (one side) of the crankshaft 51 while a generator 180 is provided on the left side (other side) of the crankshaft 51.

More specifically, the left end of the crankshaft 51 extends leftwardly in the left crankcase 24A and extends to a position in the proximity of the generator cover 25 attached so as to cover the left side opening (outside opening) of the left crankcase 24A, and the generator 180 is accommodated in a space surrounded by the generator cover 25 and the left crankcase 24A. The generator 180 includes a rotor 181 secured to the crankshaft 51 and a stator 182 disposed in the rotor 181 with the stator 182 being secured to the generator cover 25.

The belt type continuously variable transmission 60 is a power transmission mechanism of the dry type wherein lubrication by engine oil is not carried out, and is accommodated in a transmission accommodation section 61 provided on the right side (one side) of the crankshaft 51. The transmission accommodation section 61 forms a chamber having no oil and is different from that of the crankcase 24 which is lubricated by engine oil. The transmission accommodation section 61 is formed to the left and right as a two-divisional part structure of a transmission case 61A which forms a body portion of the transmission accommodation section 61. A transmission cover (cover member) 61B for covering the outer side opening (right side opening) of the transmission case 61A is provided.

More particularly, the right end of the crankshaft 51 extends to the right through the right crankcase 24B and then extends through the transmission case 61A connected to the right side of the right crankcase 24B by bolts. The right end of the crankshaft 51 further extends to a position in the proximity of the transmission cover 61B provided contiguously to the transmission case 61A, and a right end portion thereof is used as a driving pulley shaft (driving shaft) 51R of the belt type continuously variable transmission 60. A driving pulley 63 is attached to the driving pulley shaft 51R.

At a rear portion of the crankcase 24, a driven pulley shaft (driven shaft) 64 of the belt type continuously variable transmission 60 is supported laterally for rotation such that an axis C2 thereof extends perpendicularly to the advancing direction of the vehicle. The driven pulley shaft 64 is positioned to the rear of and in parallel to the driving pulley shaft 51R and is supported for rotation through a pair of left and right bearings (roller bearings) 65, 65 supported by the right crankcase 24B and the transmission accommodation section 61 (transmission case 61A).

A driven pulley 67 is attached to the driven pulley shaft 64, and a V belt 68 extends between and around the driving pulley 63 and the driven pulley 67 such that rotation of the driving pulley 63 is transmitted to the driven pulley 67. It is to be noted that seal members 69A and 69B for preventing engine oil on the crankcase 24 side from entering the transmission accommodation section 61 are interposed between the transmission accommodation section 61 and the pulley shafts 51R and 64 and the transmission accommodation section 61 is sealed from the crankcase 24.

The driving pulley 63 has a fixed half 63A which rotates together with the driving pulley shaft 51R and a movable half 63B, and the fixed half 63A is secured to the driving pulley shaft 51R while the movable half 63B is fixed for movement in an axial direction on the left side with respect to the fixed half 63A. The movable half 63B rotates together with the crankshaft 51 and slidably moves in the axial direction by an action of a weight roller 70 which moves in a centrifugal direction by centrifugal force toward or away from the fixed half 63A to vary the wrapping diameter of the V belt 68 sandwiched between the two pulley halves 63A and 63B.

The driven pulley 67 of the belt type continuously variable transmission 60 has a fixed half 67A which rotates together with the driven pulley shaft 64 and a movable half 67B. The fixed half 67A is fixed on the left side with respect to the movable half 67B. The movable half 67B is disposed for movement in the axial direction through an annular slider 71 at a right end portion of the driven pulley shaft 64 and is biased to the left (toward the fixed half 67A side) by a biasing member 72 in the form of a coil spring. Therefore, if the wrapping diameter of the V belt 68 sandwiched between the two halves 63A and 63B of the driving pulley 63 increases, then the distance between the two halves 67A and 67B of the driven pulley 67 conversely increases against the biasing force of the biasing member 72 thereby to decrease the wrapping diameter of the V belt 68. Consequently, a continuous speed variation is carried out automatically.

The driven pulley shaft 64 transmits power to a power transmission mechanism 81 disposed in the crankcase 24 through a centrifugal clutch 80 disposed in a space (clutch chamber R1 hereinafter described) formed between the right crankcase 24B and the transmission case 61A.

The centrifugal clutch 80 is a clutch of the wet type wherein lubrication and cooling of components are carried out by engine oil and includes a clutch inner race 83 spline-fitted with the driven pulley shaft 64 and a clutch outer race 85 connected to a clutch output gear 84 provided for relative rotation at a left end portion of the driven pulley shaft 64. A clutch weight 87 is provided on each of a plurality of support shafts 86 provided in a projecting manner on the outer circumferential end side of the clutch inner race 83. Therefore, if the speed of rotation of the driven pulley shaft 64 exceeds a predetermined speed, then the clutch weight 87 which moves in a centrifugal direction by centrifugal force is engaged with the clutch outer race 85 and rotates the clutch outer race 85 integrally with the driven pulley shaft 64 to rotate the clutch output gear 84.

It is to be noted that a clutch reinforcing plate 88 is provided for suppressing the clutch outer race 85 from expanding in the centrifugal direction. A retainer 90 is disposed between the clutch output gear 84 and the driven pulley shaft 64. The retainer 90 has two roller trains of bearing rollers disposed in a spaced relationship from each other in a circumferential direction such that the roller trains extend in the axial direction. The two roller trains allow the clutch output gear 84 to make relative rotation to the driven pulley shaft 64.

The power transmission mechanism 81 is a mechanism which carries out power transmission between the belt type continuously variable transmission 60 and the output power shaft 31 of the engine 20 and also functions as a primary speed reduction mechanism. The power transmission mechanism 81 includes an intermediate gear shaft (speed reduction gear shaft) 91 provided between the driven pulley shaft 64 and the output power shaft 31 for reducing the speed of rotation of the clutch output gear 84 provided on the driven pulley shaft 64 at a predetermined speed reduction ratio and transmitting the rotation of the reduced speed to the output power shaft 31. It is to be noted that the intermediate gear shaft 91 includes an axis C3, and the output power shaft 31 includes an axis C4.

The intermediate gear shaft 91 includes a penetrating shaft portion 91A supported for rotation on a pair of left and right bearings (roller bearings) 92, 92 supported on the left and right crankcases 24A and 24B and extending through a wall portion of the right crankcase 24B. To the penetrating shaft portion 91A, an intermediate shaft driven gear (speed reduction gear) 93 of a large diameter which meshes with the clutch output gear 84 provided on the driven pulley shaft 64 is secured, and an intermediate shaft driving gear 94 of a smaller diameter which meshes with a final gear 95 secured to the output power shaft 31 is secured in a space between the left and right crankcases 24A and 24B. Consequently, rotation of the clutch output gear 84 positioned on the outer side of the crankcase 24 is transmitted at a predetermined speed reduction ratio to the final gear 95 of the output power shaft 31 positioned in the crankcase 24 through the intermediate gear shaft 91.

The output power shaft 31 is supported by a pair of left and right bearings (roll bearings) 96, 96 supported on the left and right crankcases 24A and 24B. The final gear 95 is provided for rotation on the output power shaft 31, and rotation of the final gear 95 is transmitted to the output power shaft 31 through a gear damper 97.

More specifically, a space (hereinafter referred to as clutch chamber R1) surrounded by the right crankcase 24B and the transmission case 61A is formed in the neighborhood on the right of a space (hereinafter referred to as crank chamber R0) surrounded by the left and right crankcases 24A and 24B. In other words, the transmission case 61A is connected to the right crankcase 24B so that it serves also as a clutch case member which forms a clutch case.

The crank chamber R0 and the clutch chamber R1 are chambers in which lubrication and cooling by engine oil are carried out, and an oil reserving section is formed at a lower portion of the crankcase 24 and a lower portion of the transmission case 61A.

Further, a space (hereinafter referred to as transmission chamber R2) is formed between the transmission case 61A and the transmission cover 61B in the neighborhood on the right of the clutch chamber R1, and the transmission chamber R2 is a chamber in which lubrication and cooling by engine oil are not carried out. In other words, in the present engine 20, the chamber in which engine oil is used and the chamber in which no engine oil is used are partitioned definitely in the vehicle widthwise direction.

Now, the kick type starting apparatus 140 is described.

Figure 4:
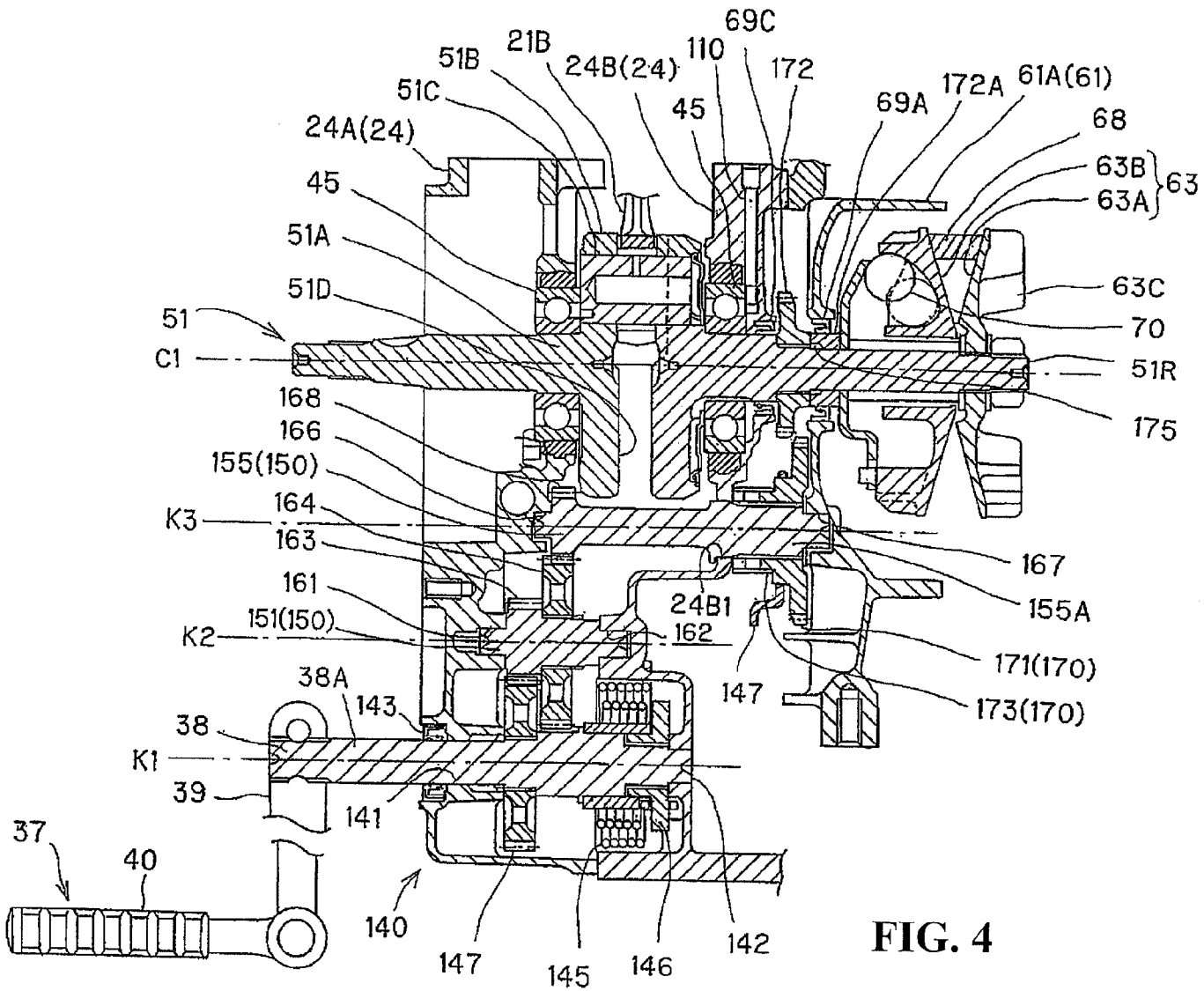
FIG. 4 is a view showing a section taken along line IV-IV of FIG. 2.

FIG. 4 is a view showing a section taken along line IV-IV and shows a mechanical portion of the kick type starting apparatus 140 together with peripheral elements. The kick type starting apparatus 140 is accommodated in a lower portion of the engine 20 (principally in a lower portion of the crankcase 24).

The kick shaft 38 is disposed at a position forwardly and downwardly of the driven pulley shaft 64 at which the kick shaft 38 does not overlap with the driven pulley 67 formed in a large diameter as viewed in a side elevation (refer to FIG. 2) and is supported for rotation by bearing portions (in the present example, plain bearings each formed from a through-hole) 141 and 142 formed in the left and right crankcases 24A and 24B. A left end portion of the kick shaft 38 extends through the bearing portion 141 formed in a wall portion of the left crankcase 24A and projects to the left, and the kick arm 39 having an end to which the kick pedal 40 is attached is secured at a base end portion thereof to the penetrating shaft portion 38A. Further, a seal member 143 which fills up a gap between the left crankcase 24A and the kick shaft 38 is provided on the left crankcase 24A. In this crankcase 24, a return spring 145 for biasing the kick shaft 38 in a reverse direction to the kicking direction and a stopper 146 for stopping the kick shaft 38 which is rotated by biasing force of the return spring 145 at a kicking operation starting position are disposed at a right side portion of the kick shaft 38, and a kick drive gear 147 of a large diameter positioned adjacent the bearing portion 141 is provided at a left side portion of the kick shaft 38.

A kick intermediate shaft 150 for transmitting rotation of the kick shaft 38 to the crankshaft 51 is disposed between the kick shaft 38 and the crankshaft 51. The kick intermediate shaft 150 of the present configuration has a two-shaft configuration and includes a first kick intermediate shaft 151 driven to rotate by the kick shaft 38 and a second kick intermediate shaft 155 for transmitting the rotation of the first kick intermediate shaft 151 to the crankshaft 51. In FIG. 2, the axis of the kick shaft 38 is denoted by reference character K1 and the axis of the first kick intermediate shaft 151 is denoted by reference character K2 while the axis of the second kick intermediate shaft 155 is denoted by reference character K3.

The first kick intermediate shaft 151 is disposed laterally at a position below an intermediate position between the driven pulley shaft 64 and the crankshaft 51 at which the first kick intermediate shaft 151 overlaps with the driven pulley 67 formed in a large diameter as viewed in side elevation as seen in FIG. 2. Further, the first kick intermediate shaft 151 is supported for rotation by a pair of left and right bearing portions (in the present example, plain bearings each formed from a non through-hole) 161 and 162 provided on the left and right crankcases 24A and 24B as seen in FIG. 4. With the first kick intermediate shaft 151, a first kick intermediate shaft driven gear (kick driven gear) 163 of a small diameter which is accommodated fully in the crankcase 24 and meshes with the kick drive gear 147 is formed integrally. Further, a first kick intermediate shaft driving gear (first idle gear) 164 of a larger diameter than that of the first kick intermediate shaft driven gear 163 is secured to the first kick intermediate shaft 151 rightwardly of and adjacent the first kick intermediate shaft driven gear 163.

As shown in FIG. 2, the second kick intermediate shaft 155 is disposed laterally at a position rearwardly and downwardly of the crankshaft 51 at which the second kick intermediate shaft 155 does not overlap with the driven pulley 67 formed in a large diameter as viewed in side elevation. As shown in FIG. 4, the second kick intermediate shaft 155 is supported for rotation by a pair of left and right bearing portions (in the present example, plain bearings each formed from a non through-hole) 166 and 167 provided on the left crankcase 24A and the transmission case 61A. This second kick intermediate shaft 155 is formed as a shaft longer than the first kick intermediate shaft 151 such that it extends through and outwardly from an opening 24B1 formed in the wall portion of the right crankcase 24B in a state wherein it is supported at a left end portion thereof by the left crankcase 24A. The extension shaft portion 155A of the second kick intermediate shaft 155 extends over the space (clutch chamber R1) between the crankcase 24 and the transmission case 61A and is supported for rotation by the transmission case 61A. At a shaft portion of the second kick intermediate shaft 155 in the crankcase 24, a second intermediate shaft driven gear (second idle gear) 168 of a small diameter which meshes with the first kick intermediate shaft driving gear 164 of the first kick intermediate shaft 151 is formed integrally. A dive gear mechanism 170 is disposed at the extension shaft portion 155A of the kick intermediate shaft 155 outside the crankcase 24.

The dive gear mechanism 170 is formed as a mechanism which includes a dive gear 171 is positioned between the right crankcase 24B and the transmission case 61A and is provided for movement with respect to the second kick intermediate shaft 155. A biasing member 173 for biasing the dive gear 171 to a retracted position at which the dive gear 171 does not mesh with a kick starting driven gear 172 is provided on the crankshaft 51. A friction spring 174 is wrapped around the dive gear 171 and is supported on the transmission case 61A wherein the dive gear 171 is slidably moved to the left side by rotation of the second kick intermediate shaft 155 upon kicking until it is brought into meshing engagement with the kick starting driven gear 172. It is to be noted that, while, in the example shown, a coil spring is used as the biasing member 173, a spring other than the coil spring such as a leaf spring or a coned disk spring may be used.

Accordingly, if the kick pedal 40 is stepped down and the kick shaft 38 is rotated against the biasing force of the return spring 145, then the rotation of the kick shaft 38 is transmitted through the gear train of the first kick intermediate shaft 151 and the second kick intermediate shaft 155 to move the dive gear 171 in a direction in which the dive gear 171 is brought into meshing engagement with the kick starting driven gear 172 so that the crankshaft 51 can be rotated compulsorily to start the engine 20.

As shown in FIG. 2, an oil pump 100 for supplying engine oil to the components of the engine 20 is provided in the crankcase 24 of the engine 20. This oil pump 100 is provided at a forwardly obliquely downward position with respect to the crankshaft 51 and is driven by rotating force of the crankshaft 51 by a cam chain driving to discharge the engine oil so that the engine oil is supplied to the bearings such as the bearings 45, 45 for supporting the crankshaft 51, a valve motion (not shown) of the cylinder section 22, the centrifugal clutch 80 and the power transmission mechanism 81 and so forth.

Further, an extension 106 which extends outwardly from the engine 20 is provided on the engine 20, and heat radiating fins are formed on the extension 106 and an oil path (oil passage) 108 is formed in the engine 20 to carry out cooling of the oil.

More specifically, the extension 106 extends from the transmission case 61A which forms the body portion of the transmission accommodation section 61 to the front side of the vehicle body substantially along the cylinder axial line L1. An oil path cover 107 is connected to the extension 106 by means of bolts. The substantially annular oil path 108 is formed and heat radiating fins are provided between the extension 106 and the oil path cover 107 such that oil flowing in the oil path 108 is cooled efficiently by running wind through the heat radiating fins. Further, the section modulus of the extension 106 and the oil path cover 107 becomes high and the rigidity is sufficiently assured. In other words, the extension 106 and the oil path cover 107 function as a small-sized oil cooler 105 (refer to FIGS. 2 and 3) of the type integrated with the engine.

In the present configuration, oil pressured-fed from the oil pump 100 is branched, and the oil in one system passes along an oil path (not shown) connecting to the cylinder section 22 to lubricate the components of the cylinder section 22 and then returns to the oil reserving section at a lower portion of the crankcase 24 by natural dropping. In the other system, the oil passes through the oil cooler 105 and then passes an oil path 110 illustrated in FIG. 3 to lubricate the components of the crankshaft 51, whereafter it naturally drops and returns to the oil reversing section. It is to be noted that naturally the oil pressure-fed from the oil pump 100 may be branched after it passes through the oil cooler 105.

Figure 5:
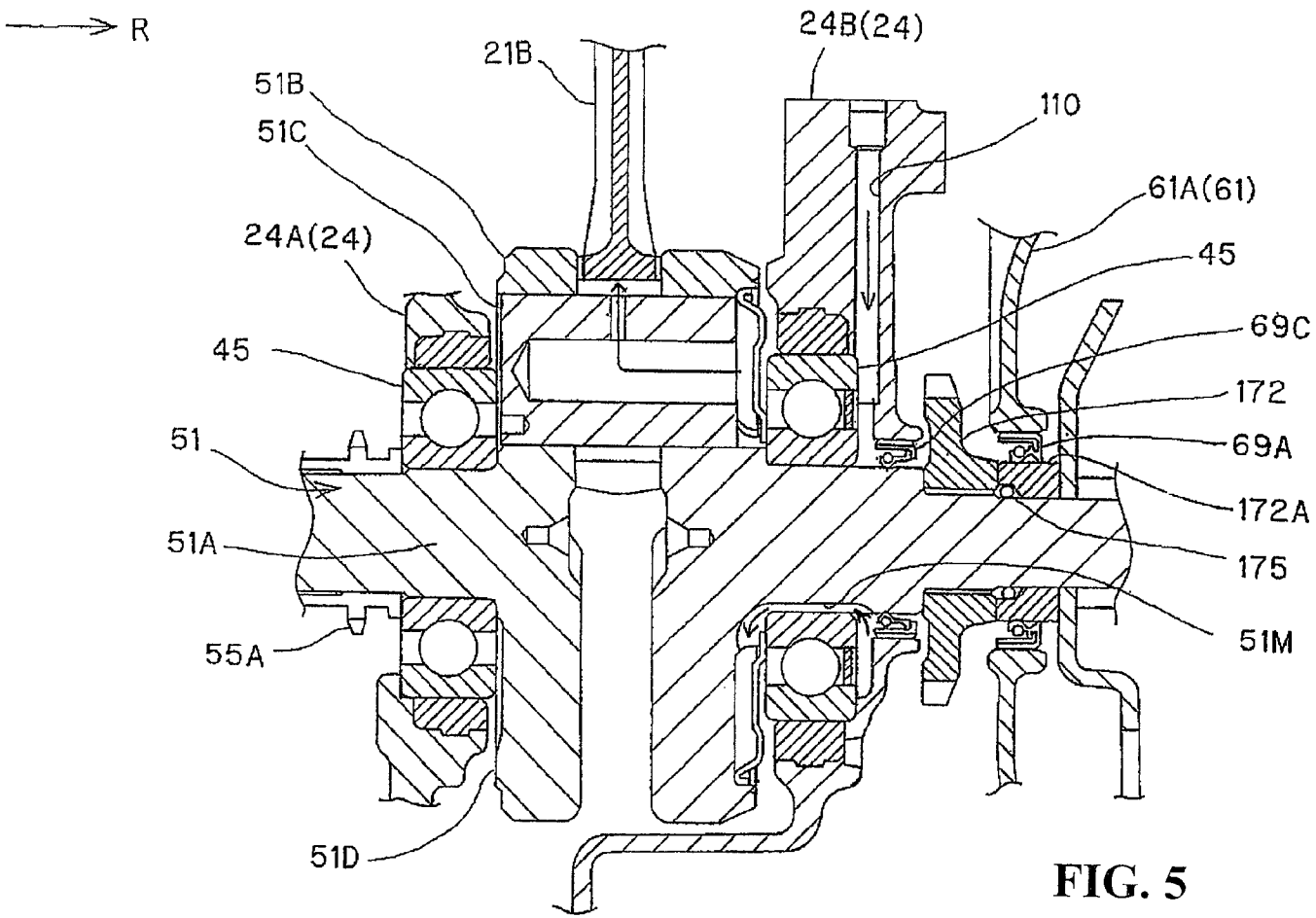
FIG. 5 is a view showing a crankshaft of the engine together with peripheral elements.

As shown in FIG. 5, in the present configuration, the oil path 110 along which oil from the oil pump 100 is pressure-fed is configured so as to supply oil between the bearing 45 on the right side from between the pair of left and right bearings 45 which support the crankshaft 51 and a seal member 69C which seals between the crankshaft 51 and the right crankcase 24B.

The oil flowing out from the oil path 110 enters the crankcase 24 past an oil passage groove 51M formed between the right bearing 45 and the crankshaft 51 and then is supplied to a large end portion of the connecting rod 21B along an oil path not shown formed in the crank pin 51C.

More specifically, in the present configuration, since the oil passage groove 51M which cooperates with the bearing 45 to form a gap therebetween such that oil is passed to the crank pin 51C side is formed on the outer circumferential face of the crankshaft 51, oil can be supplied to the sliding face of the connecting rod 21B and so forth without forming an oil path in the crankshaft 51. It is to be noted that a plurality of such oil passage grooves 51M may be formed in a spaced relationship from each other in the circumferential direction of the crankshaft 51 or a single oil passage groove 51M may be formed if sufficient lubrication is assured.

Further, as shown in FIG. 5, in the present configuration, an O-snap ring 175 is not disposed on an inner circumference of the kick starting driven gear 172, but is disposed on an inner circumference of a collar 172A which is inserted until it is abutted with an end face of the kick starting driven gear 172 after the kick starting driven gear 172 is fitted on the crankshaft 51. If the kick starting driven gear 172 and the collar 172A are formed from a single integrated part, then since the O-snap ring 175 is disposed on an inner circumference of the part, it is necessary to pay attention so that the position of the O-snap ring upon assembly of the same may not be displaced.

In contrast, in the present configuration, since the kick starting driven gear 172 and the collar 172A are formed as separate members from each other and the O-snap ring 175 is disposed between the members, the collar 172A may be fitted on the crankshaft 51 after the O-snap ring 175 is assembled to its assembly position of the crankshaft 51. Accordingly, the O-snap ring 175 can be assembled readily without any positional displacement, and the assembly performance of the O-snap ring 175 is improved.

In this instance, the gap on the inner circumference side of the collar 172A (gap between the collar 172A and the crankshaft 51) is sealed with the O-snap ring 175 and the gap on the outer circumference side of the collar 172A (gap between the collar 172A and the transmission case 61A) is sealed with the seal member 69A, the sealing performance between the transmission accommodation section 61 and the crankcase 24 can be sufficiently assured.

In addition, in the case of the configuration wherein oil pressure-fed to and heated by the cylinder or the like is pressure-fed to the cylinder section 22 or the like by the oil pump 100 immediately after it returns to the oil chamber serving as an oil reserving section, the oil is cooled a little in the oil chamber, and even if the oil path 108 described above is provided, in an environment of use wherein the average temperature is high, an increase in the oil cooling capacity is demanded. On the other hand, with the method wherein a large-sized oil cooler separate from an engine is additionally provided to increase the oil cooling capacity, not only the number of parts increases to increase the cost and the weight, but in a small-sized vehicle like the present vehicle, it is difficult to assure an arrangement space for the large-sized oil cooler.

Therefore, in the present engine 20, the oil heat radiation amount from an oil chamber is configured such that a crank side oil chamber RA which functions as an oil reserving section of the crankcase 24 is divided into a first oil chamber RO1 and a second oil chamber RO2 and oil heated by the cylinder section 22 or the like flows from the first oil chamber RO1 to a transmission side oil chamber RB which functions as an oil reserving section of the transmission case 61A and then flows from the transmission side oil chamber RB to the second oil chamber, whereafter the oil is sucked out by an oil pump so that the oil heat radiation amount from the oil chamber is increased. In the following, this oil chamber structure is described in detail.

Figure 6:
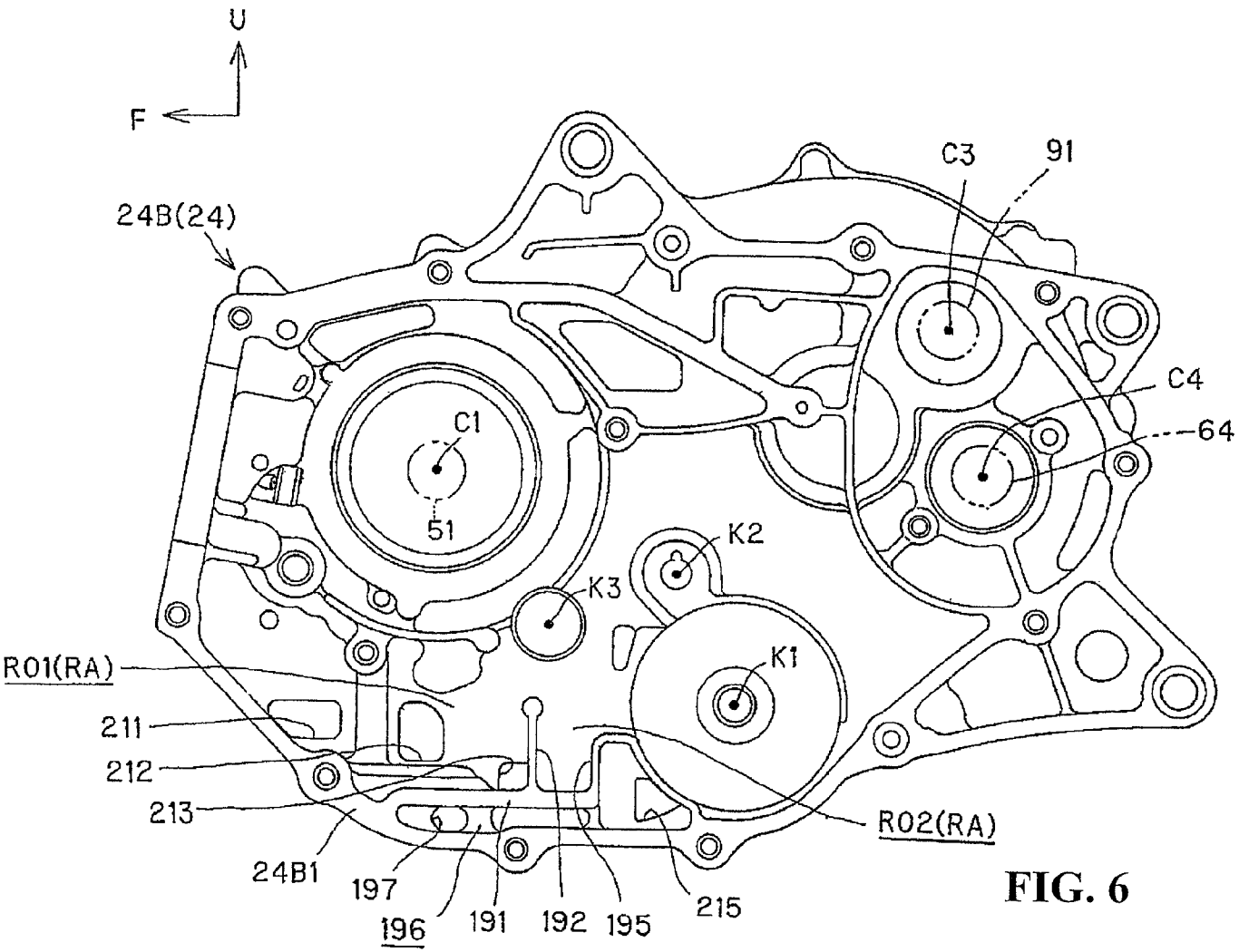
FIG. 6 is a view of a right crankcase as viewed from the inner side (left side)
Figure 7:
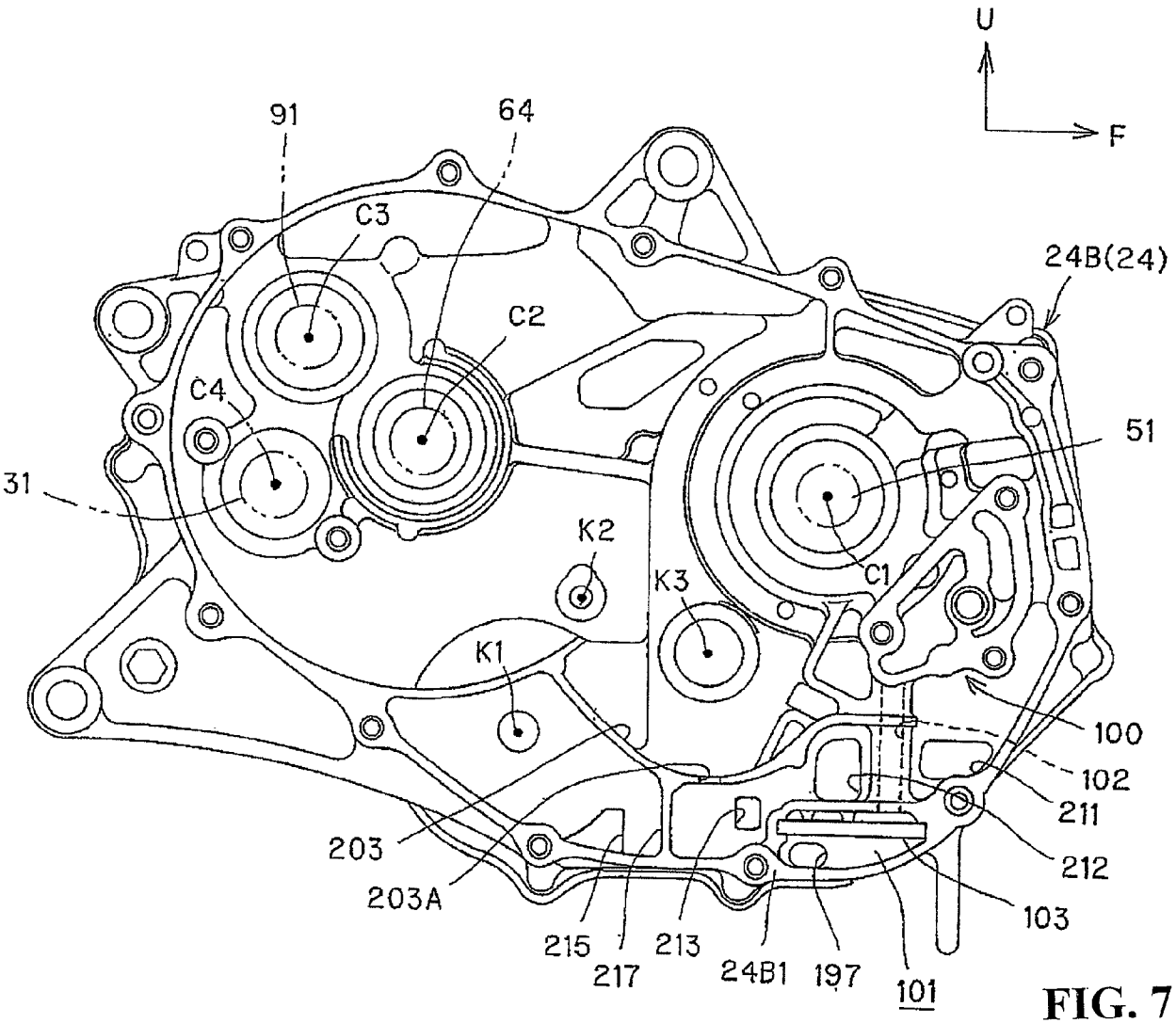
FIG. 7 is a view of the right crankcase as viewed from the outer side (right side)
Figure 8:
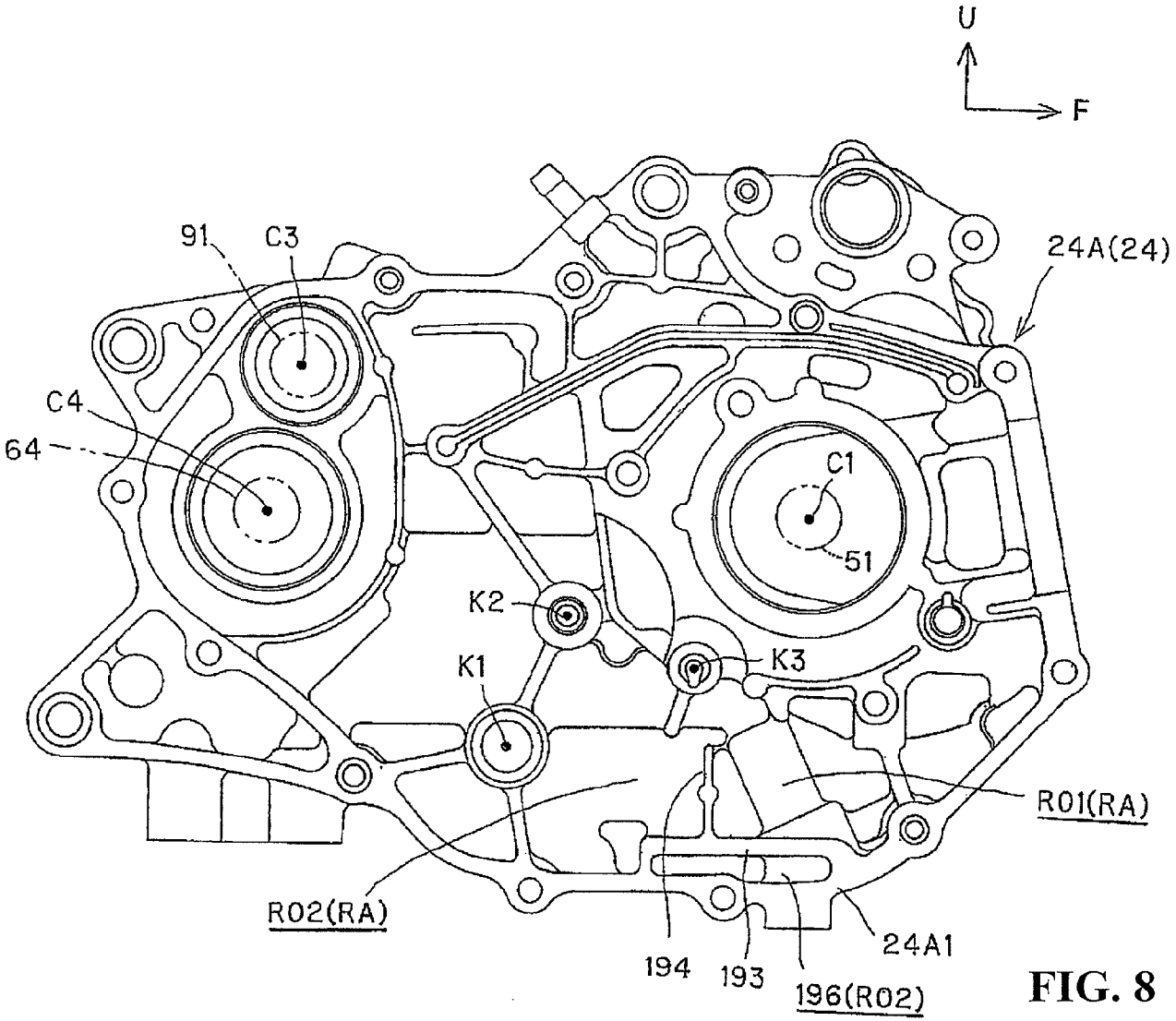
FIG. 8 is a view of a left crankcase as viewed from the inner side (right side)
Figure 9:
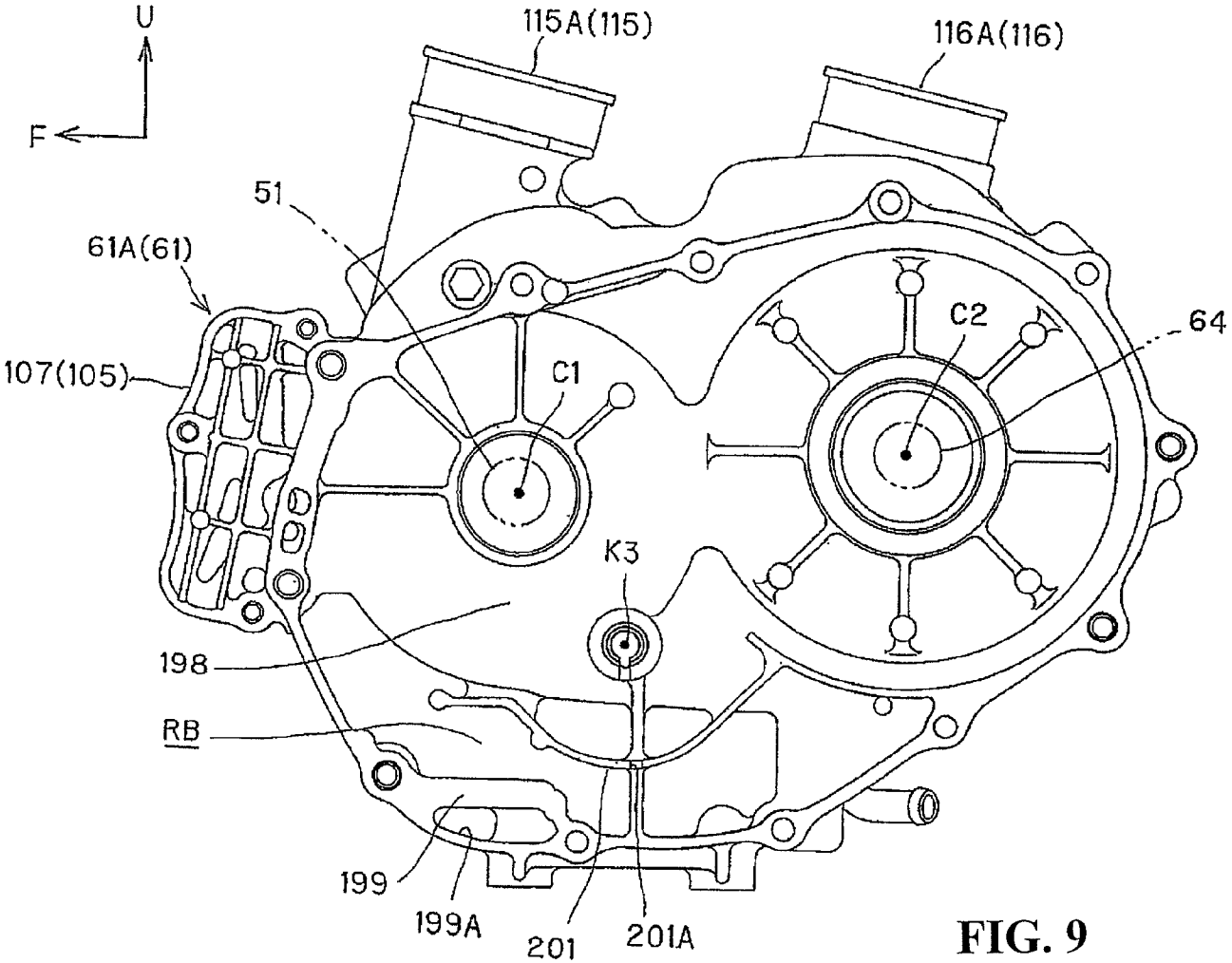
FIG. 9 is a view of a transmission case as viewed from the right crankcase side (left side)

FIG. 6 is a view of the right crankcase 24B as viewed from the inner side (left side), and FIG. 7 is a view of the right crankcase 24B as viewed from the outer side (right side). FIG. 8 is a view of the left crankcase 24A as viewed from the inner side (right side) and FIG. 9 is a view of the transmission case 61A as viewed from the right crankcase 24B side (left side).

On the inner side of the right crankcase 24B, a up/down partitioning rib 191 for partitioning a bottom side space of the right crankcase 24B upwardly and downwardly and a front/rear partitioning rib 192 for partitioning an upper side space partitioned by the up/down partitioning rib 191 forwardly and backwardly as seen in FIG. 6 are provided. Also on the inner side of the left crankcase 24A, an up/down partitioning rib 193 for partitioning the bottom side space of the left crankcase 24A upwardly and downwardly is provided so as to connect to the up/down partitioning rib 191 as shown in FIG. 7, and a front/rear partitioning rib 194 for partitioning the upper side space partitioned by the up/down partitioning rib 193 of the left crankcase 24A forwardly and backwardly is provided so as to connect to the front/rear partitioning rib 192.

In particular, the left and right up/down partitioning ribs 191 and 193 and the left and right front/rear partitioning ribs 192 and 194 are formed in a leftwardly and rightwardly symmetrically shaped relationship with a parting plane of the left and right crankcases 24A and 24B and extend along the left and right walls of the crankcase 24. Therefore, the inside of the crankcase 24 is partitioned forwardly and backwardly by the front/rear partitioning ribs 192 and 194, and the front side chamber is formed as the first oil chamber RO1 and the rear side chamber is formed as the second oil chamber RO2.

Since the first oil chamber RO1 is formed on the front side in the inside of the crankcase 24, it serves as an oil chamber into which not only oil having lubricated the portions of the cylinder section 22 enters but also oil having lubricated the portions of the crankshaft 51, that is, oil heated by the components of the engine 20, enters first.

Here, the front/rear partitioning ribs 192 and 194 which partition the rear end of the first oil chamber RO1 are provided rearwardly and downwardly of the crankshaft 51 as shown in FIGS. 6 and 8. More particularly, the front/rear partitioning ribs 192 and 194 extend upwardly and downwardly below the second kick intermediate shaft 155 (axis K3) positioned rearwardly and downwardly of the crankshaft 51. Consequently, return oil from the cylinder section 22 and the crankshaft 51 side does not directly enter the second oil chamber RO2 exceeding the front/rear partitioning ribs 192 and 194 but enters the first oil chamber RO1 with certainty.

Meanwhile, the second oil chamber RO2 is, in the right crankcase 24B, partitioned upwardly and downwardly by a rib 195 which extends rearwardly from a lower end of the up/down partitioning rib 191 and forms a wall portion which is projecting upwardly and then connects to the opening 24B1 of the right crankcase 24B as seen in FIG. 6. However, in the left crankcase 24A, such a rib like the rib 195 which partitions the second oil chamber RO2 upwardly and downwardly as seen in FIG. 8 does not exist. Consequently, the second oil chamber RO2 continues upwardly and downwardly in such a manner so as to extend across the rib 195 upwardly and downwardly in the left crankcase 24A.

Further, the left and right up/down partitioning ribs 191 and 193 extend forwardly in the left and right crankcases 24A and 24B and connect at the front ends thereof to bottom plates 24A1 and 24B1 of the crankcases 24A and 24B (refer to FIGS. 6 and 7). Consequently, the up/down partitioning ribs 191 and 193 partition the first oil chamber RO1 and a space portion 196 below the first oil chamber RO1 fully from each other.

This lower space portion 196 extends between the left and right crankcases 24A and 24B and forms part of the second oil chamber RO2. Sidewardly (rightwardly) of the space portion 196, that is, on the opposite side with respect to the side wall of the right crankcase 24B, a strainer chamber 101 which forms a strainer from which oil is sucked out by the oil pump 100 is formed as seen in FIG. 7. This strainer chamber 101 and the space portion 196 which forms part of the second oil chamber RO2 are in communication with each other through an opening (hereinafter referred to as third opening) 197 formed in the side wall of the space portion 196. It is to be noted that a suction path 102 extending downwardly from the oil pump 100 positioned above the strainer chamber 101 is in communication with the strainer chamber 101, and another strainer (filter) 103 is disposed below the suction path 102.

Further, in the present structure, the transmission side oil chamber RB serving as an oil reserving section is formed also at a lower portion of the transmission case 61A. More particularly, a lower portion of the transmission case 61A is depressed to the right side farther than a portion (for example, a portion of the side wall of the transmission case 61A through which the driving pulley shaft 51R shown in FIG. 3 extends) which projects most to the left side (crankcase 24 side). The space between the side wall of the transmission case 61A including this depressed portion 198 (refer to FIG. 9) and the left crankcase 24A functions as the transmission side oil chamber RB.

As shown in FIG. 9, a strainer chamber covering portion 199 for covering a sideward opening of the strainer chamber 101 formed in the right crankcase 24B is formed integrally on the transmission case 61A. Consequently, the transmission side oil chamber RB is configured so as not to communicate directly with the strainer chamber 101. It is to be noted that, on the strainer chamber covering portion 199, a depressed portion 199A which is depressed in the widthwise direction in such a manner as to expand the space of the strainer chamber 101 is formed, and the strainer chamber 101 is expanded to the transmission case 61A side by the depressed portion 199A.

Meanwhile, an oil receiving rib 201 which projects from the side wall of the transmission case 61A in such a manner so as to extend in the forward and backward direction is formed on the transmission case 61A. This rib 201 extends below and over the parts (crankshaft 51, second kick intermediate shaft 155, driven pulley shaft 64 and gears and the centrifugal clutch 80 which are supported on the crankshaft 51, second kick intermediate shaft 155 and driven pulley shaft 64) disposed between the transmission case 61A and the crankcase 24, and receives oil having lubricated the parts and allows the oil to drop into the transmission side oil chamber RB through a hole 201A formed at a predetermined location. Since oil having lubricated the parts is collected into and dropped through the hole 201A provided at the predetermined location in this manner the appearance of bubbles in the oil can be suppressed.

It is to be noted that, as shown in FIG. 7, also on the transmission side oil chamber RB side of the right crankcase 24B, an oil receiving rib 203 and a hole 203A formed in a substantially leftwardly and rightwardly symmetrical shape with the oil receiving rib 201 and the hole 201A with respect to the parting plane between the right crankcase 24B and the transmission case 61A are provided. Oil from the parts is received by the left and right oil receiving ribs 201 and 203 and dropped from the predetermined location into the transmission side oil chamber RB.

The transmission side oil chamber RB extends forwardly and backwardly over a lower portion of the transmission case 61A and is provided at a position at which it overlaps with the first oil chamber RO1 and the second oil chamber RO2 in the crankcase 24 as viewed in side elevation.

Further, as shown in FIG. 6, in the side wall of the right crankcase 24B, first openings 211, 212 and 213 for communicating the first oil chamber RO1 with the transmission side oil chamber RB are formed and a second opening 215 for communicating the transmission side oil chamber RB with the second oil chamber RO2 is formed. Consequently, oil entering the first oil chamber RO1 flows into the transmission side oil chamber RB through the first openings 211 to 213, and the oil in the transmission side oil chamber RB flows into the second oil chamber RO2 through the second opening 215. Then, the oil entering the second oil chamber RO2 flows into the strainer chamber 101 (refer to FIG. 7) through the third opening 197 and sucked out by the oil pump 100.

Therefore, describing the direction of a flow of oil briefly, oil entering the first oil chamber RO1 first moves to the right of the engine 20 through the first openings 211 to 213 and enters the transmission side oil chamber RB. In the transmission side oil chamber RB, the oil moves in the rearward direction (backward direction) of the engine 20 and then moves in the leftward direction of the engine 20 through the second opening 215 until it enters the second oil chamber RO2. In the second oil chamber RO2, the oil moves in the forward direction of the engine 20 and the moves in the rightward direction of the engine 20 through the third opening 197 until it enters the strainer chamber 101.

Since the engine oil flows into the strainer chamber 101 along a circulating path along which the engine oil circulates in the engine widthwise directions and forward and backward directions in the engine 20 in this manner, the oil flowing path in the oil chamber (crank side oil chamber RA and transmission side oil chamber RB) can be made long and the oil residence time can be made long. Consequently, the oil heat radiation amount can be increased as much. In addition, since the circulating path of the oil chamber is formed over the crankcase 24 and the transmission case 61A, heat radiation of the oil can be carried out making use of the outer surfaces of both of the crankcase 24 and the transmission case 61A. The heat radiation amount of the oil can be increased also by increase of the heat radiation face for the oil.

In addition, since, in the present configuration, returning oil heated by various portions such as the cylinder section 22 and the crankshaft 51 enters the first oil chamber RO1 as described above, returning oil having passed through a high temperature portion of the engine 20 can be cooled efficiently through the longest oil flow path.

Further, in the present configuration, since the second opening 215 for communicating the transmission side oil chamber RB with the second oil chamber RO2 is provided at a position lower than that of the first openings 211 to 213 which communicate the first oil chamber RO1 with the transmission side oil chamber RB and the third opening 197 for communicating the second oil chamber RO2 with the strainer chamber 101 is provided at a position lower than that of the second opening 215 as shown in FIGS. 6 and 7, the oil can be fed along the first oil chamber RO1→transmission side oil chamber RB→second oil chamber RO2→strainer chamber 101 making use of the gravity, and a situation in which the oil flows in the opposite direction to that of the flow described above can be eliminated.

Further, in the present configuration, since the first openings 211 to 213 and the second opening 215 are formed in a spaced relationship from each other in the forward and backward direction and also the second opening 215 and the third opening 197 are formed in a spaced relationship from each other in the forward and backward direction, the distance of movement in the oil chamber in the forward and backward direction of the engine can efficiently be made long. More particularly, at least by forming the first opening 211 at the front end of the bottom portion of the crankcase 24 and forming the second opening 215 at a rear end of the bottom portion of the crankcase 24 and further forming the third opening 197 on the front side of the bottom portion of the crankcase 24, the distance of movement in the forward and backward direction of the engine can be made long and the oil heat radiation amount can efficiently be increased.

Further, in the present configuration, since a plurality of (in the present example, three) first openings 211 to 213 are formed in a spaced relationship from each other in the forward and backward direction, a wide oil path can be assured from the first oil chamber RO1 to the transmission side oil chamber RB, and oil entering several locations of the front side, an intermediate portion in the forward and backward direction and a rear portion of the first oil chamber RO1 can be introduced readily and immediately to the transmission side oil chamber RB side. Since it is considered that, during driving of the engine, the temperature of the transmission case 61A is lower than that of the crankcase 24, if oil in the crankcase 24 is fed immediately into the transmission case 61A, then heat radiation of the oil can efficiently be carried out. Also by this, the oil heat radiation amount can be increased.

Further, since the first opening 213 is formed along a corner portion formed by the up/down partitioning rib 191 (and 193) and the front/rear partitioning rib 192 (and 194) as seen in FIG. 6, return oil flowing along the ribs 191 to 194 can be introduced smoothly into the transmission side oil chamber RB through the first opening 213. In other words, it is possible to cause the up/down partitioning ribs 191 and 193 and the front/rear partitioning ribs 192 and 194 to function as guide members for guiding return oil from the cylinder section 22 into the transmission side oil chamber RB.

Further, in the present configuration, the transmission side oil chamber RB is formed over the right crankcase 24B and the transmission case 61A and a partition wall 217 for partitioning in the upward and downward direction is provided between the first openings 211 to 213 and the second opening 215 on the right crankcase 24B side while no such partition wall is provided on the transmission case 61A side. Therefore, oil entering the transmission side oil chamber RB through the first openings 211 to 213 does not flow rearwardly of the engine 20 and enter the second opening 215, but the rearward flow of the oil is stopped by the partition wall 217 and flows in the rightward direction of the engine 20. Consequently, the oil enters the second opening 215 bypassing the partition wall 217. Consequently, the oil flow path in the transmission side oil chamber RB can be made long, and the oil heat radiation amount can be further increased.

Further, in the present configuration, since the first oil chamber RO1 and the second oil chamber RO2 are formed over the overall width of the crankcase 24, heat of the oil can be radiated not only through the bottom plates 24A1 and 24B1 of the crankcase 24 but also through the opposite side walls. Further, heat of the oil can be discharged to the outside also through the bottom plate and the side walls of the transmission case 61A by the transmission side oil chamber RB. Accordingly, a wide oil heat radiation face can be assured, and the oil heat radiation amount can be further increased.

As described above, in the present embodiment, since the transmission side oil chamber RB partitioned from the transmission accommodation section 61 is provided at a lower portion of the transmission case 61A such that oil is circulated through the transmission side oil chamber RB, the oil flow path in the oil chamber can be made long and the oil residence time can be made long, and the oil heat radiation amount from the oil chamber can be increased. Accordingly, oil after heat radiation is reserved in the oil reservoir. Consequently, even if a large-sized oil cooler is not provided additionally, the oil cooling amount by the air-cooled engine can be enhanced.

In addition, in the present configuration, the crank side oil chamber RA formed in the crankcase 24 is divided into the first oil chamber RO1 and the second oil chamber RO2 and the first openings 211 to 213 which communicate with the transmission side oil chamber RB formed in the transmission case 61A are provided in the first oil chamber RO1 while the second opening 215 which communicates with the second oil chamber RO2 is provided in the transmission side oil chamber RB, the oil flow path in the oil chamber can be made long efficiently and the oil residence time can be made long efficiently. Accordingly, the oil heat radiation amount from the oil chamber can be increased efficiently.

Further, since the third opening 197 which communicates with the strainer chamber 101 from which oil is sucked out by the oil pump 100 is provided in the second oil chamber RO2, oil in the first oil chamber RO1 and the transmission side oil chamber RB enters the strainer chamber 101 past the second oil chamber RO2. Therefore, in comparison with the alternative configuration wherein return oil directly enters the strainer chamber 101, the oil flow path and the oil residence time in the oil chamber can be made long and the oil heat radiation amount from the oil chamber can be increased. Consequently, oil whose heat has been radiated can be supplied to the strainer 103.

Further, since the first oil chamber RO1 is provided at a position to which return oil from the cylinder section 22 drops and the second oil chamber RO2 is provided rearwardly of the first oil chamber RO1 while the strainer chamber 101 is provided forwardly of the second oil chamber RO2 below the first oil chamber R01, return oil from the cylinder section 22 can be dropped into the first oil chamber RO1 with certainty so that heat radiation from the oil chamber can efficiently be carried out. Further, the first oil chamber RO1 and the strainer chamber 101 can be disposed in an overlapping relationship with each other as viewed from above, and a limited space can be utilized efficiently to dispose the first oil chamber RO1, second oil chamber RO2 and strainer chamber 101.

Further, since the second opening 215 is positioned lower than the first openings 211 to 213 and the third opening 197 is positioned lower than the second opening 215, oil can be introduced smoothly from the first oil chamber RO1 to the transmission side oil chamber RB making use of the gravity and oil can be introduced smoothly from the transmission side oil chamber RB to the second oil chamber RO2 making use of the gravity.

Further, since a lower portion of the transmission case 61A is depressed toward the transmission chamber R2 side to form the transmission side oil chamber RB, the transmission side oil chamber RB is positioned below the transmission chamber R2. If the transmission side oil chamber RB is positioned below the transmission chamber R2, then also the outer surface of the transmission side oil chamber RB on the transmission chamber R2 side can be made function as an oil heat radiation face, and since the oil heat radiation face increases, the oil heat radiation amount can be increased as much.

Furthermore, since, in the present configuration, the up/down partitioning ribs 191 and 193 and the front/rear partitioning ribs 192 and 194 are provided so as to extend between the left and right walls of the crankcase 24 and the first opening 213 is provided at a position at which return oil from the cylinder section 22 which flows along the ribs 191 to 194 is introduced to the transmission side oil chamber RB, the ribs 191 to 194 can be caused to function as guide members for guiding return oil smoothly to the transmission side oil chamber RB. In this instance, since the guide members are provided so as to extend between the left and right walls of the crankcase 24, return oil from the cylinder section 22 can be guided to the transmission side oil chamber RB with a higher degree of certainty.

Hereinafter, a wind guide structure of the belt type continuously variable transmission 60 is described.

Into the transmission chamber R2, that is, into the transmission accommodation section 61, external air is introduced such that the belt type continuously variable transmission 60 is cooled with the thus introduced external air.

As shown in FIG. 2, an external air intake port 115 is provided at a front upper portion of the transmission case 61A which corresponds to a position above the driving pulley 63 while an external air exhaust port 116 is provided at a rear upper portion of the transmission case 61A which corresponds to a position above the driven pulley 67. The external air intake port 115 and the external air exhaust port 116 have duct portions 115A and 116A which are provided in a spaced relationship from each other in the forward and backward direction and extend rearwardly upwardly in parallel to each other. The external air intake port 115 and the external air exhaust port 116 are formed integrally with the transmission case 61A. A duct not shown is connected to an upper end portion of each of the external air intake port 115 and the external air exhaust port 116 such that external air can be communicated through the ducts. It is to be noted that in FIG. 2 a drainage hole 62 is provided for discharging water therethrough in the transmission case 61A (in the transmission chamber R2).

Blowing fins 63C for allowing the driving pulley 63 to function as a blower fan are provided on the fixed half 63A of the driving pulley 63 disposed in the transmission accommodation section 61. If the blowing fins 63C revolve by rotation of the driving pulley 63, then external air is taken into the transmission chamber R2 from the external air intake port 115.

Further, blowing fins 67C for allowing the driven pulley 67 to function as a blower are provided also on the fixed half 67A of the driven pulley 67 in the transmission accommodation section 61. By revolution of the blowing fins 67C, external air taken in from the external air intake port 115 can be taken in to the driven pulley 67 side in the transmission chamber R2 and can be exhausted from the external air exhaust port 116. By this, a flow of external air from the driving pulley 63 side toward the driven pulley 67 side is produced in the transmission chamber R2, and the belt type continuously variable transmission 60 is forcibly air-cooled.

It is to be noted that, in FIG. 2, the direction of rotation of each of the driving pulley 63 and the driven pulley 67 is indicated by an arrow mark. Both of the driving pulley 63 and the driven pulley 67 rotate in the clockwise direction as viewed in right side elevation so that external air can be taken in smoothly from the external air intake port 115 and the taken-in external air can be exhausted smoothly from the external air exhaust port 116.

Figure 10:
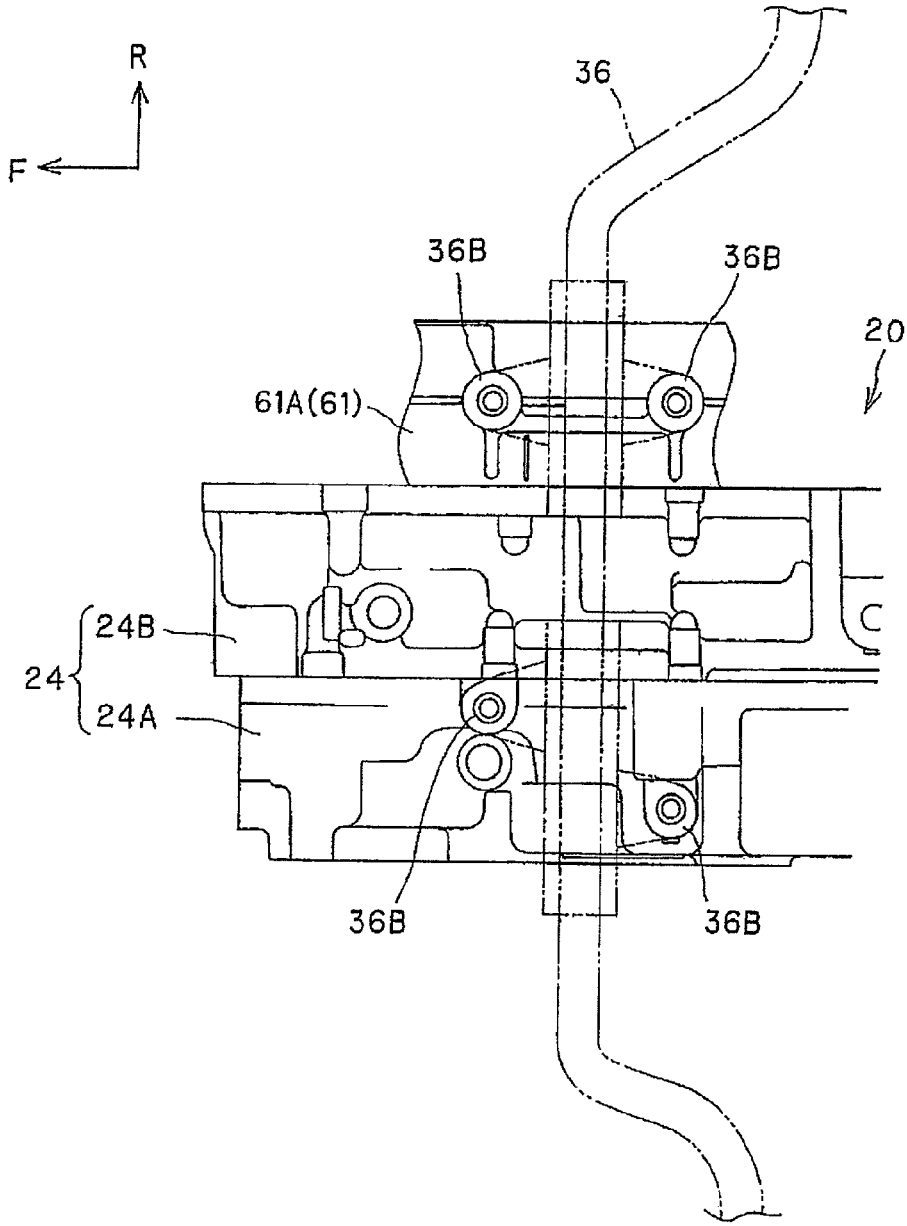
FIG. 10 is a view of the engine as viewed from the lower side.

FIG. 10 is a view of the engine 20 as viewed from the lower side. As described hereinabove, in the present engine 20, the crankcase 24 is composed of the left crankcase 24A and the right crankcase 24B and the transmission case 61A is connected to the right side of the right crankcase 24B, and this transmission case 61A functions also as a clutch case for covering the centrifugal clutch 80. Since an oil reserving section is formed also at a lower portion of the transmission case 61A, the lower face of the crankcase 24 and the lower face of the transmission case 61A become lower faces of the oil reserving sections (crank side oil chamber RA and transmission side oil chamber RB) and lie almost in flush with each other (refer to FIG. 2).

In the present configuration, a pair of front and rear boss portions (step bar supporting portions) 36B which project downwardly are provided in the oil reserving section (crank side oil chamber RA) of the crankcase 24 while a pair of front and rear boss portions (step bar supporting portions) 36B which project downwardly are provided also on the oil reserving section (transmission side oil chamber RB) at the lower portion of the transmission case 61A, and flange bolts not shown for attaching the step bar 36 extending in the leftward and rightward directions of the vehicle body are fastened to the boss portions 36B.

By the configuration, the distance between the supporting portions of the step bar 36 in the leftward and rightward direction can be assured wider than that in an alternative case wherein the step bar 36 is supported otherwise only by the crankcase 24.

Hereinafter, the gear damper 97 is described.

Figure 11:
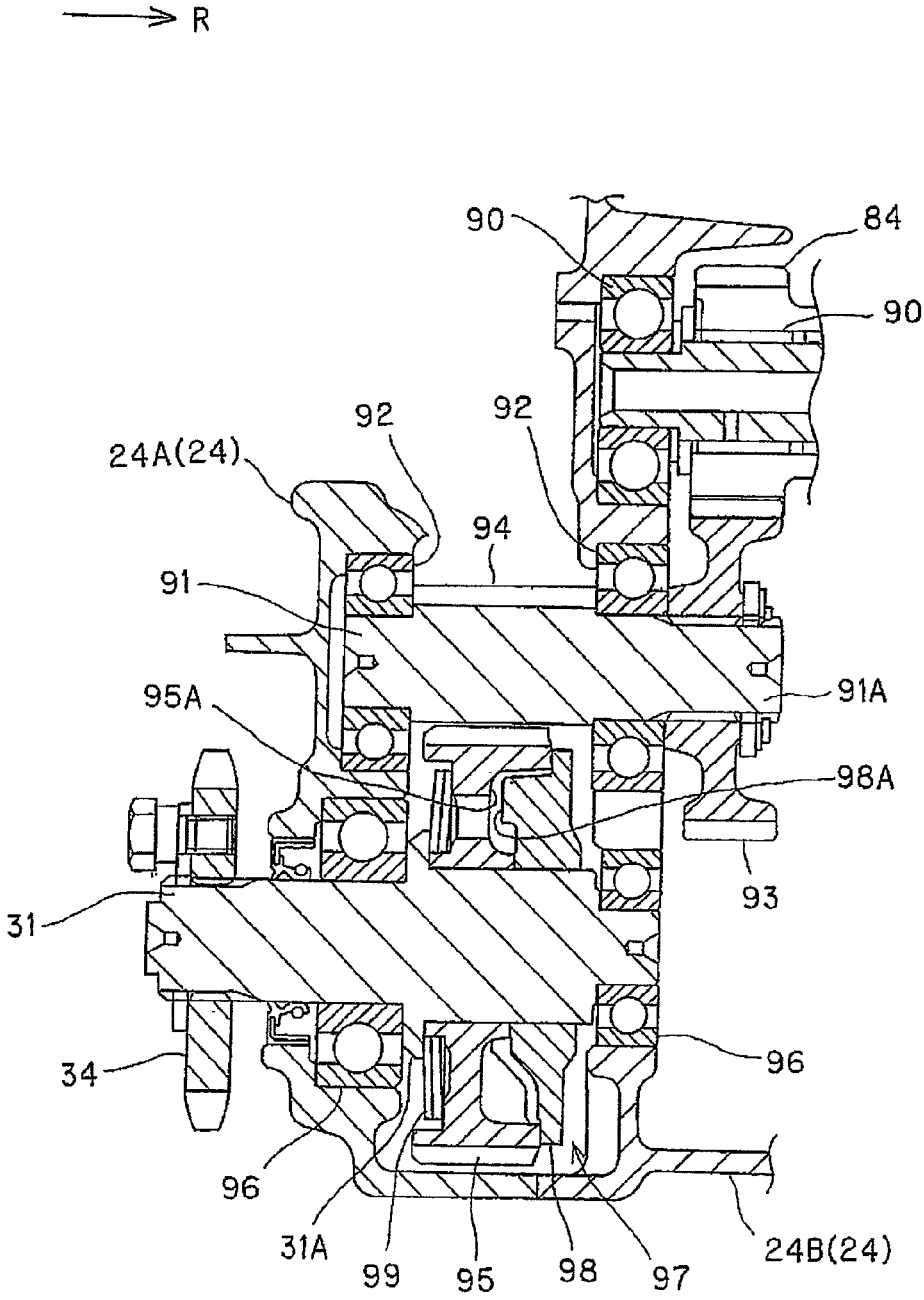
FIG. 11 is a view showing a gear damper together with peripheral elements.

FIG. 11 is a view showing the gear damper 97 provided on the output power shaft 31 together with peripheral elements.

A damper holding member 98 is provided adjacent the right side of the final gear 95 on the output power shaft 31. This damper holding member 98 is secured to the output power shaft 31 by force fitting so that it rotates integrally with the output power shaft 31.

The final gear 95 is held for rotation on the output power shaft 31, and an increased diameter portion 31A serving as a spring receiving portion is provided integrally on the output power shaft 31 on the left side of the final gear 95. A spring member 99 (in the present example, a plurality of disk springs) is interposed between the increased diameter portion 31A and a left end face of the final gear 95 such that the final gear 95 is biased toward the damper holding member 98 side by elastic force of the spring members 99.

Figure 12A:
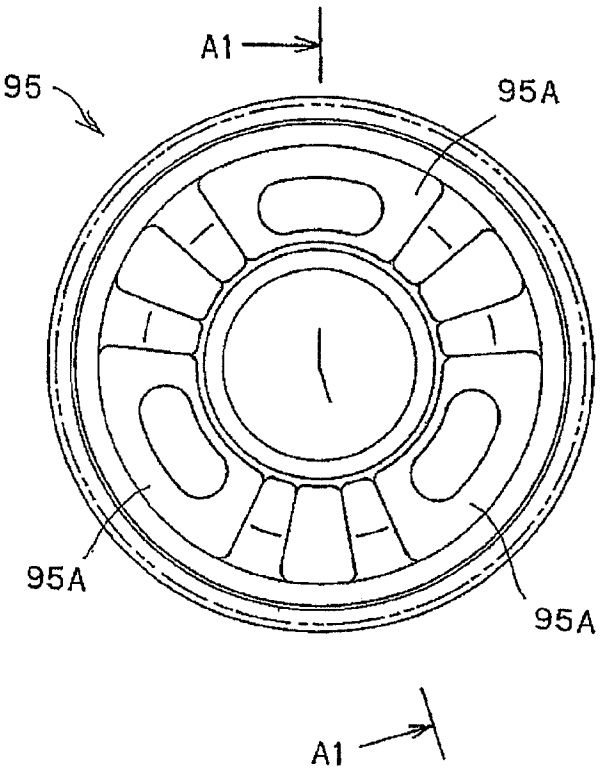
FIG. 12(A) is a side elevational view of a final gear.
Figure 12B:
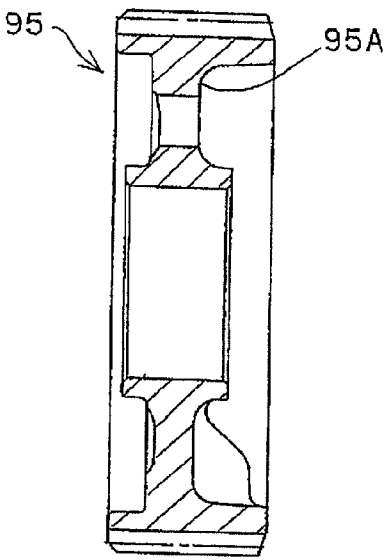
FIG. 12(B) is a view showing a section of the final gear taken along line A1-A1.
Figure 13B:
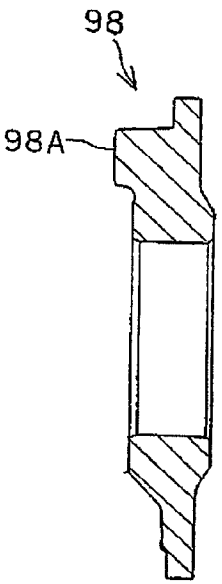
FIG. 13(B) is a view showing a section of the damper holding member taken along line A2-A2.
Figure 13A:
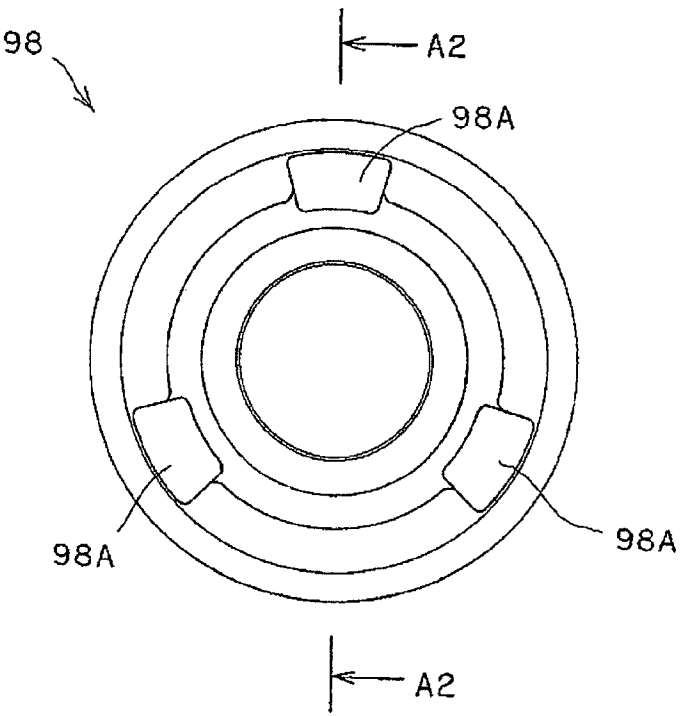
FIG. 13(A) is a side elevational view of a damper holding member.

FIG. 12(A) is a side elevational view of the final gear 95 and FIG. 12(B) is a view showing a section taken along line A1-A1 of the final gear 95. FIG. 13(A) is a side elevational view of the damper holding member 98 and FIG. 13(B) is a view showing a section taken along line A2-A2 of the damper holding member 98.

As shown in FIGS. 12(A) to 13(B), a plurality of (in the example shown, three) depressed cams 95A are formed at intervals of an equal angle on a face of the final gear 95 on the damper holding member 98 side. Projecting cams 98A for meshing with the depressed cams 95A are formed on a face of the damper holding member 98 on the final gear 95 side.

Where driving torque acts from the engine 20 side and torque in the opposite direction to the driving direction (so-called back torque) does not act from the driving wheel side (rear wheel 15 side), the depressed cams 95A of the final gear 95 and the projecting cams 98A of the damper holding member 98 mesh with each other, and the output power shaft 31 is driven to rotate by the driving torque from the engine 20 side so that the rear wheel 15 serving as a driving wheel is driven.

On the other hand, if back torque acts from the driving wheel side (rear wheel 15 side), then the projecting cams 98A of the damper holding member 98 circumferentially slip with respect to the depressed cams 95A of the final gear 95 against the elastic force of the spring members 99 acting upon the final gear 95 thereby to moderate transmission of back torque to the engine 20 side. A gear damper of the cam type which absorbs from the driving wheel side by this action is disposed in the crankcase 24.

Figure 14:
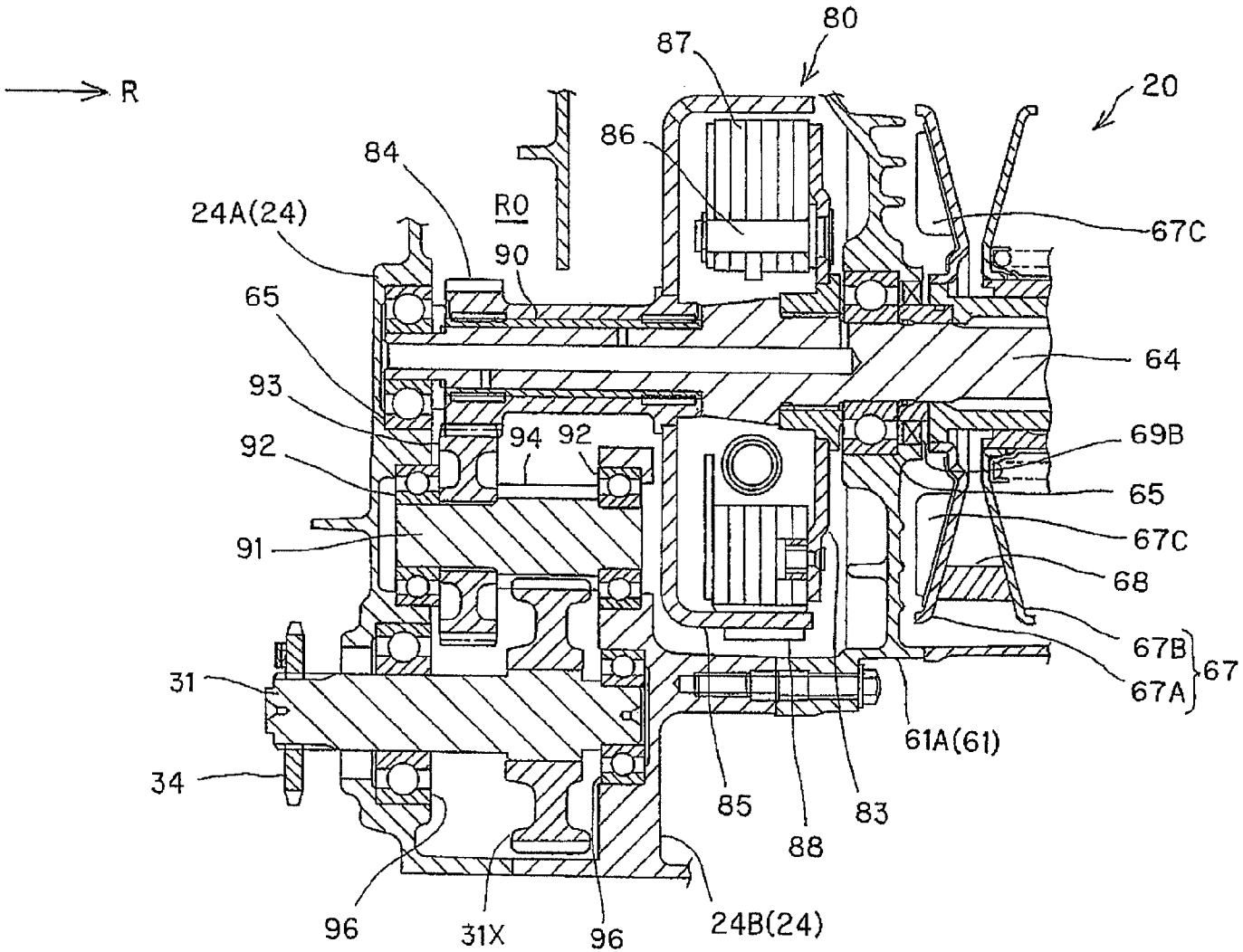
FIG. 14 is a view illustrating a modification.

While the present invention has been described in connection with an embodiment thereof, the present invention is not limited to this. For example, while, in the embodiment described above, the driven pulley shaft (driven shaft) 64 is supported by the pair of left and right bearings 65, 65 individually disposed in the right crankcase 24B and the transmission case 61A, the supporting configuration for the driven pulley shaft 64 is not limited to this. As shown in FIG. 14 in which an example is shown, the left end of the crankcase 24 is extended to the left through the right crankcase 24B until it is supported by one of the bearings 65 disposed on the left crankcase 24A. With the present configuration, since the clutch output gear 84 provided on the driven pulley shaft 64 is disposed in the left and right crankcases 24A and 24B, the intermediate shaft driven gear (speed reduction gear) 93 which meshes with the clutch output gear 84 is positioned in the left and right crankcases 24A and 24B, and the necessity for a member for preventing letting off of the intermediate shaft driven gear 93 is eliminated.

Further, in the configuration shown in FIG. 14, instead of the fact that the gear damper 97 is not provided for the output power shaft 31 of the engine 20, an output power shaft gear 31X which meshes with the intermediate shaft driving gear 94 for transmitting rotation of the intermediate shaft driven gear 93 to the output power shaft 31 is force-fitted with or spline-coupled to the output power shaft 31 so that the output power shaft 31 is driven to rotate. In this manner, presence or absence of the gear damper 97, the supporting position of the driven pulley shaft (driven shaft) 64 and so forth can be readily changed in design.

Further, while, in the embodiment described above, the present invention is applied to a single-cylinder engine, the application of the present invention is not limited to this, and the present invention may be applied to a so-called V-type engine wherein different cylinders are disposed so as to form a predetermined angle of nip therebetween or a parallel type engine wherein different cylinders are disposed in parallel to each other.

Further, while, in the embodiment described above, the present invention is applied to an internal combustion engine for a motorcycle, the application of the present invention is not limited to this, and it is possible to apply the present invention to an internal combustion engine which is used in other vehicles than the motorcycle.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An internal combustion engine wherein a transmission case which accommodates a transmission is provided on one side of a crankcase which supports a crankshaft and a crank side oil chamber is provided at a lower portion of said crankcase comprising:

a transmission side oil chamber partitioned from a transmission accommodation section is provided at a lower portion of said transmission case such that oil is circulated through said transmission side oil chamber, wherein said crank side oil chamber has a first oil chamber and a second oil chamber separate from each other, and a first opening is in constant flow communication with said transmission side oil chamber provided in said first oil chamber while a second opening is in constant flow communication with said second oil chamber provided in said transmission side oil chamber.

2. The internal combustion engine according to claim 1, wherein a third opening communicating with a strainer of an oil pump is provided in said second oil chamber.

3. The internal combustion engine according to claim 2, wherein said first oil chamber is provided at a position to which returning oil from a cylinder section of said internal combustion engine drops and said second oil chamber is provided rearwardly of said first oil chamber while said strainer chamber is provided forwardly of said second oil chamber below said first oil chamber.

4. The internal combustion engine according to claim 2, wherein said second opening is positioned lower than said first opening and said third opening is positioned lower than said second opening.

5. The internal combustion engine according to claim 3, wherein said second opening is positioned lower than said first opening and said third opening is positioned lower than said second opening.

6. The internal combustion engine according to claim 1, wherein said transmission side oil chamber is positioned below said transmission chamber of said transmission case in which said transmission is accommodated.

7. An internal combustion engine according to claim 1, wherein a guide member for guiding returning oil from a cylinder section of said internal combustion engine to said transmission side oil chamber is provided on the inner side of said crankcase.

8. The internal combustion engine according to claim 7, wherein said guide member is provided so as to extend between left and right walls of said crankcase.

9. The internal combustion engine according to claim 1, wherein oil flows outwardly from a first oil path to enter the crankcase past an oil passage groove formed between a right bearing and the crankshaft to an end portion of a connecting rod and along a second oil path formed in a crank pin.

10. An internal combustion engine including a transmission case for accommodating a transmission is provided on one side of a crankcase which supports a crankshaft comprising:

a crank side oil chamber formed at a lower portion of said crankcase; and a transmission side oil chamber formed from a transmission accommodation section, said transmission side oil chamber being provided at a lower portion of said transmission case;

wherein oil is circulated through said transmission side oil chamber, wherein said crank side oil chamber has a first oil chamber and a second oil chamber separate from each other, and a first opening is in constant flow communication with said transmission side oil chamber provided in said first oil chamber while a second opening is in constant flow communication with said second oil chamber provided in said transmission side oil chamber.

11. The internal combustion engine according to claim 10, wherein a third opening communicating with a strainer of an oil pump is provided in said second oil chamber.

12. The internal combustion engine according to claim 11, wherein said first oil chamber is provided at a position to which returning oil from a cylinder section of said internal combustion engine drops and said second oil chamber is provided rearwardly of said first oil chamber while said strainer chamber is provided forwardly of said second oil chamber below said first oil chamber.

13. The internal combustion engine according to claim 11, wherein said second opening is positioned lower than said first opening and said third opening is positioned lower than said second opening

14. The internal combustion engine according to claim 12, wherein said second opening is positioned lower than said first opening and said third opening is positioned lower than said second opening.

15. The internal combustion engine according to claim 10, wherein said transmission side oil chamber is positioned below said transmission chamber of said transmission case in which said transmission is accommodated.

16. The internal combustion engine according to claim 10, wherein a guide member for guiding returning oil from a cylinder section of said internal combustion engine to said transmission side oil chamber is provided on the inner side of said crankcase.

17. The internal combustion engine according to claim 16, wherein said guide member is provided so as to extend between left and right walls of said crankcase.

18. The internal combustion engine according to claim 10, wherein oil flows outwardly from a first oil path to enter the crankcase past an oil passage groove formed between a right bearing and the crankshaft to an end portion of a connecting rod and along a second oil path formed in a crank pin.

* * * * *